US009416620B2

(12) United States Patent
Hannegan

(10) Patent No.: US 9,416,620 B2
(45) Date of Patent: Aug. 16, 2016

(54) CEMENT PULSATION FOR SUBSEA WELLBORE

(71) Applicant: Weatherford Technology Holdings, LLC, Houston, TX (US)

(72) Inventor: Don M. Hannegan, Fort Smith, AR (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 14/634,276

(22) Filed: Feb. 27, 2015

(65) Prior Publication Data

US 2015/0267504 A1 Sep. 24, 2015

Related U.S. Application Data

(60) Provisional application No. 61/968,051, filed on Mar. 20, 2014.

(51) Int. Cl.

| | |
|---|---|
| ***E21B 33/05*** | (2006.01) |
| ***E21B 33/134*** | (2006.01) |
| ***E21B 33/14*** | (2006.01) |
| ***E21B 19/09*** | (2006.01) |
| ***E21B 21/10*** | (2006.01) |
| ***E21B 21/08*** | (2006.01) |
| ***E21B 19/00*** | (2006.01) |
| ***E21B 33/12*** | (2006.01) |
| ***E21B 34/06*** | (2006.01) |
| ***E21B 28/00*** | (2006.01) |

(52) U.S. Cl.

CPC ..... *E21B 33/143* (2013.01); *E21B 19/002* (2013.01); *E21B 28/00* (2013.01); *E21B 33/12* (2013.01); *E21B 33/14* (2013.01); *E21B 34/06* (2013.01)

(58) Field of Classification Search

None

See application file for complete search history.

(56) References Cited

U.S. PATENT DOCUMENTS

| | | | | |
|---|---|---|---|---|
| 4,093,028 | A * | 6/1978 | Brandon | B06B 3/00 166/281 |
| 4,393,932 | A | 7/1983 | Bodine | |
| 4,640,372 | A | 2/1987 | Davis | |
| 4,653,587 | A | 3/1987 | Bodine | |
| 5,361,837 | A | 11/1994 | Winbow | |
| 5,377,753 | A | 1/1995 | Haberman et al. | |
| 5,439,290 | A | 8/1995 | Wicks, III et al. | |
| 6,053,245 | A | 4/2000 | Haberman | |

(Continued)

OTHER PUBLICATIONS

Active Heave Compensator, Ocean Drilling Program note, date unknown, 3 pages.

(Continued)

*Primary Examiner* — Matthew R Buck
*Assistant Examiner* — Douglas S Wood
(74) *Attorney, Agent, or Firm* — Patterson & Sheridan LLP

(57) ABSTRACT

A method for cementing a tubular string into a wellbore from a drilling unit includes: running the tubular string into the wellbore using a workstring; hanging the tubular string from a wellhead or from a lower portion of a casing string set in the wellbore; and pumping cement slurry through the workstring and tubular string and into an annulus formed between the tubular string and the wellbore. The method further includes, during thickening of the cement slurry: circulating a liquid or mud through a loop closed by a seal engaged with an outer surface of the workstring, the closed loop being in fluid communication with the annulus, and periodically choking the liquid or mud, thereby pulsing the cement slurry.

26 Claims, 15 Drawing Sheets

(56) References Cited

U.S. PATENT DOCUMENTS

| | | | | |
|---|---|---|---|---|
| 7,013,997 | B2 * | 3/2006 | Vail, III | E21B 7/065 166/386 |
| 7,997,345 | B2 | 8/2011 | Hannegan | |
| 8,047,282 | B2 | 11/2011 | Lewis et al. | |
| 8,347,982 | B2 | 1/2013 | Hannegan et al. | |
| 8,424,605 | B1 | 4/2013 | Schultz et al. | |
| 8,973,674 | B2 * | 3/2015 | Leuchtenberg | E21B 19/006 166/358 |
| 8,978,750 | B2 * | 3/2015 | Noske | E21B 34/08 166/332.8 |
| 2008/0271896 | A1 | 11/2008 | Inderberg et al. | |
| 2009/0154282 | A1 | 6/2009 | Satoh | |
| 2010/0044032 | A1 | 2/2010 | Kabishcher et al. | |
| 2013/0118752 | A1 * | 5/2013 | Hannegan | E21B 33/16 166/336 |
| 2014/0196905 | A1 | 7/2014 | Schultz et al. | |

OTHER PUBLICATIONS

Aslakson, John, et al.—"Preventing Annular Flow After Cementing, One Pulse at a Time: Offshore Gulf of Mexico Cement Pulsation Field Results," SPE 94230, paper prepared for presentation at the 2005 SPE Production and Operations Symposium held in Oklahoma City, Oklahoma, Apr. 17-19, 2005, 8 pages.

Bourgoyne, Jr., Adam T., et al.—"A Review of Sustained Casing Pressure Occurring on the OCS," Louisiana State University study funded by the Minerals Management Services U.S. Department of the Interior, 2000, 61 pages.

Cooke, Jr., C.E, et al.—3-page summary of journal paper "Annular Pressure and Temperature Measurements Diagnose Cementing Operations," SPE-11416-PA, Journal of Petroleum Technology, vol. 36, Issue 12, 1984.

Cooke, Jr., C.E, et al.—3-page summary of journal paper "Field Measurements of Annular Pressure and Temperature During Primary Cementing," SPE-11206-PA, Journal of Petroleum Technology, vol. 35, Issue 8, 1983.

Dusterhoft, Dale, et al.—3-page summary of conference paper "Field Study on the Use of Cement Pulsation to Control Gas Migration," SPE-75689-MS, SPE Gas Technology Symposium, Calgary, Alberta, Canada, Apr. 30-May 2, 2002.

Feng, F.—Abstract of "The Application of shear, cyclone and pulsation cementing technology in adjustment wells of Daqing Oilfield," Control No. 853, 1 page; and Soucy, K.S., et al.—Abstract of "The Use of Pulsation Combined With Proper Cement Slurry Design to Prevent Gas Migration," Control No. 2659, 1 page, both from Oasis, Online Abstract Submission and Invitation System—Review (http://www.abstractsonline.com/review/Print/Abstract.asp?AcctKey . . . ).

Haberman, J.P., et al.—2-page summary of conference paper "Reciprocating Cement Slurries After Placement by Applying Pressure Pulses in the Annulus," SPE-37619-MS, Speiiadc Drilling Conference, Amsterdam, Netherlands, Mar. 4-6, 1997.

M-I Swaco—"eChoke" brochure, 2004, 2 pages.

National Commission on the BP Deepwater Horizon Oil Spill and Offshore Drilling, Chief Counsel's Report | 2011—"Macondo—The Gulf Oil Disaster," Chapter 4.5 | Temporary Abandonment, pp. 127-141.

Skalle, P., et al.—3-page summary of conference paper "Vibration of Oil Well Cement," SPE-24508-MS, Abu Dhabi Petroleum Conference, Abu Dhabi, May 18-20, 1992.

TTS Drilling Solutions—"Casing XRV" brochure, date unknown, 2 pages.

Wojtanowicz, Andrew K., et al.—3-page summary of conference paper "Cement Pulsation Treatment in Wells," SPE-77752-MS, SPE Annual Technical Conference and Exhibition, San Antonio, Texas, Sep. 29-Oct. 2, 2002.

Wojtanowicz, Andrew K., et al.—Final Report: "Top Cement Pulsation for Prevention of Flow After Cementing," Louisiana State University study submitted to US Department of Interior Minerals Management Service, Sep. 15, 2000, 61 pages.

PCT International Search Report and Written Opinion dated Jul. 8, 2015, for International Application No. PCT/US2015/019672.

Lian, Zhanghua, et al.—"Propagation equations support top cement pulsation technique," Oil and Gas Journal, vol. 98, No. 32, Aug. 7, 2000, pp. 39-42.

* cited by examiner

CEMENT PULSATION FOR SUBSEA WELLBORE

BACKGROUND OF THE DISCLOSURE

1. Field of the Disclosure

The present disclosure generally relates to cement pulsation for a subsea wellbore.

2. Description of the Related Art

A wellbore is formed to access hydrocarbon bearing formations, such as crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing or liner in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be hung off of the existing casing. The second casing or liner string is then cemented. This process is typically repeated with additional casing or liner strings until the well has been drilled to total depth. In this manner, wells are typically formed with two or more strings of casing/liner of an ever-decreasing diameter.

The migration of gas from a hydrocarbon bearing formation into the cement slurry may occur after the cement has been pumped, but before it has fully cured. The consequences include gas cut cement, sustained casing pressure, and/or blow outs to the surface. The control of gas migration is one of the most costly and challenging technical problems in well cementing. The basic cause of gas migration is believed to be the loss of hydrostatic pressure within the cement column as it makes the transformation from a liquid slurry to a solid. The development of gel strength in the static column of the curing cement slurry is primarily responsible for this loss of hydrostatic pressure. This loss of hydrostatic pressure allows an influx of gas before the cement slurry has completed the curing process.

Gas migration can be prevented if gelling of the cement slurry can be prevented or delayed until the cement slurry develops enough viscosity to prevent the movement of gas within the slurry. Gelling can be disrupted by mechanical agitation, such as by rotation of the casing or liner string. However, rotation must be stopped when the drag on the casing or liner string at the bottom of the well becomes too high and before torque builds to the point that the casing or liner string might be twisted off. This may occur before the cement slurry is viscous enough to prevent gas migration at shallower depths because the cement slurry tends to cure faster at the bottom of the wellbore due to the higher temperature. Gas pulsation has also been used to disrupt gelling in subterranean and shallow water wells having surface wellheads but is unsuitable for deeper wells having subsea wellheads due to the risk of riser collapse and/or buoyancy destabilization of the floating offshore drilling unit.

SUMMARY OF THE DISCLOSURE

The present disclosure generally relates to cement pulsation for a subsea wellbore. In one embodiment, a method for cementing a tubular string into a wellbore from a drilling unit includes: running the tubular string into the wellbore using a workstring; hanging the tubular string from a wellhead or from a lower portion of a casing string set in the wellbore; and pumping cement slurry through the workstring and tubular string and into an annulus formed between the tubular string and the wellbore. The method further includes, during thickening of the cement slurry: circulating a liquid or mud through a loop closed by a seal engaged with an outer surface of the workstring, the closed loop being in fluid communication with the annulus, and periodically choking the liquid or mud, thereby pulsing the cement slurry.

In another embodiment, a method for cementing a tubular string into a subsea wellbore from an offshore drilling unit includes: running the tubular string into the subsea wellbore using a workstring; hanging the tubular string from a subsea wellhead or from a lower portion of a casing string set in the subsea wellbore; pumping cement slurry through the workstring and tubular string and into an annulus formed between the tubular string and the subsea wellbore; closing a seal against an outer surface of the workstring and closing a return line, thereby forming a closed heave chamber in fluid communication with the annulus; and maintaining the closed heave chamber during thickening of the cement slurry, thereby utilizing heaving of the offshore drilling unit to pulsate the cement slurry.

In another embodiment, a method for cementing a tubular string into a subsea wellbore from an offshore drilling unit includes: running the tubular string into the subsea wellbore using a workstring having a deployment assembly; hanging the tubular string from a subsea wellhead or from a lower portion of a casing string set in the subsea wellbore; pumping cement slurry through the workstring and tubular string and into an annulus formed between the tubular string and the subsea wellbore; releasing the deployment assembly from the tubular string; raising the deployment assembly from the tubular string to accommodate heave; and anchoring the workstring to the offshore drilling unit. The method further includes, during thickening of the cement slurry and while a seal is engaged with an outer surface of the workstring: using a heave sensor to monitor the heave, injecting liquid or mud into a return line in fluid communication with the annulus during a swab stroke of the heave, the liquid or mud being injected upstream of a fast acting choke valve, and operating the fast acting choke valve to dampen a pulse exerted on the cement slurry by the heave.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
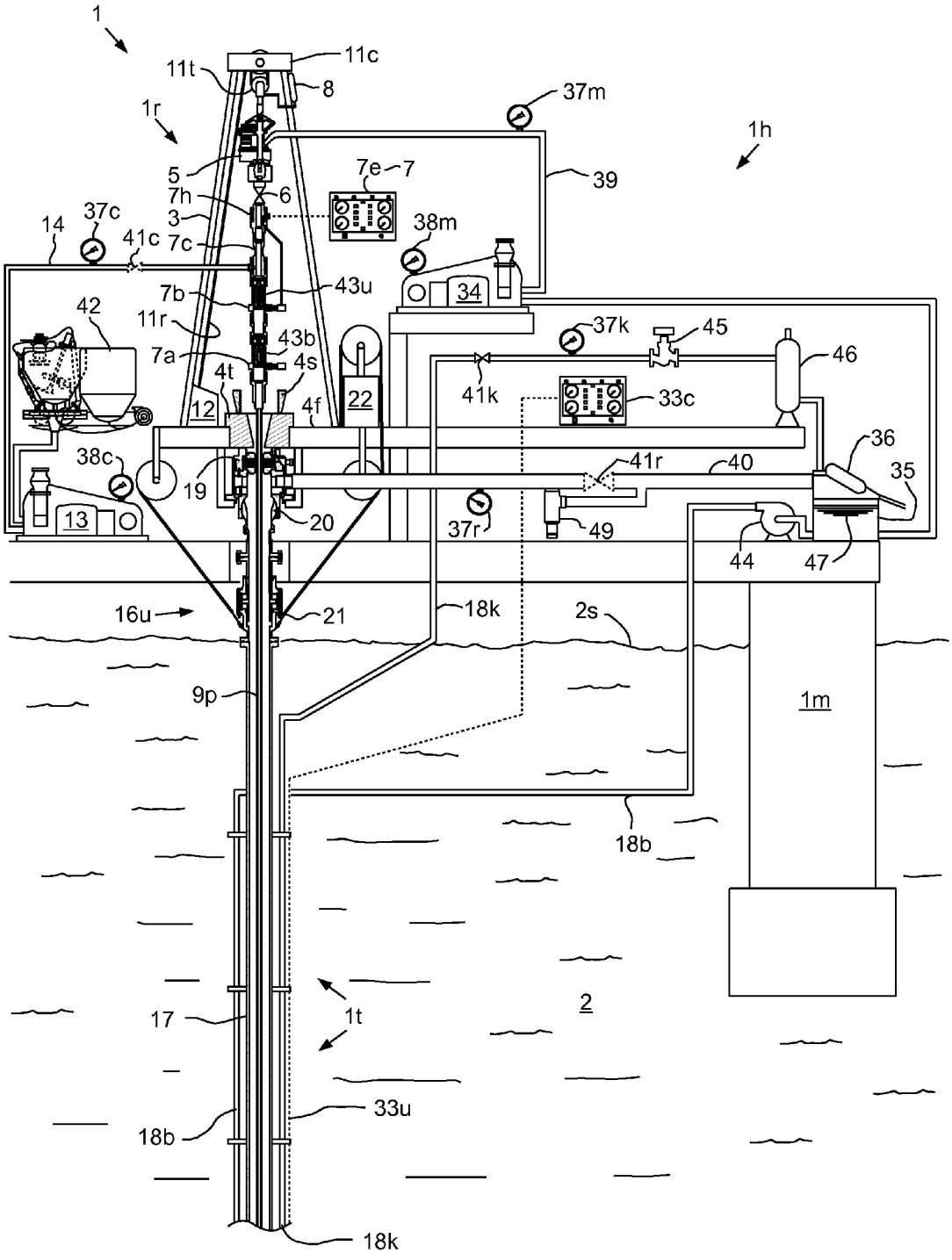
FIGS. 1A-1C illustrate a drilling system in a cement injection mode, according to one embodiment of this disclosure.
Figure 1B:
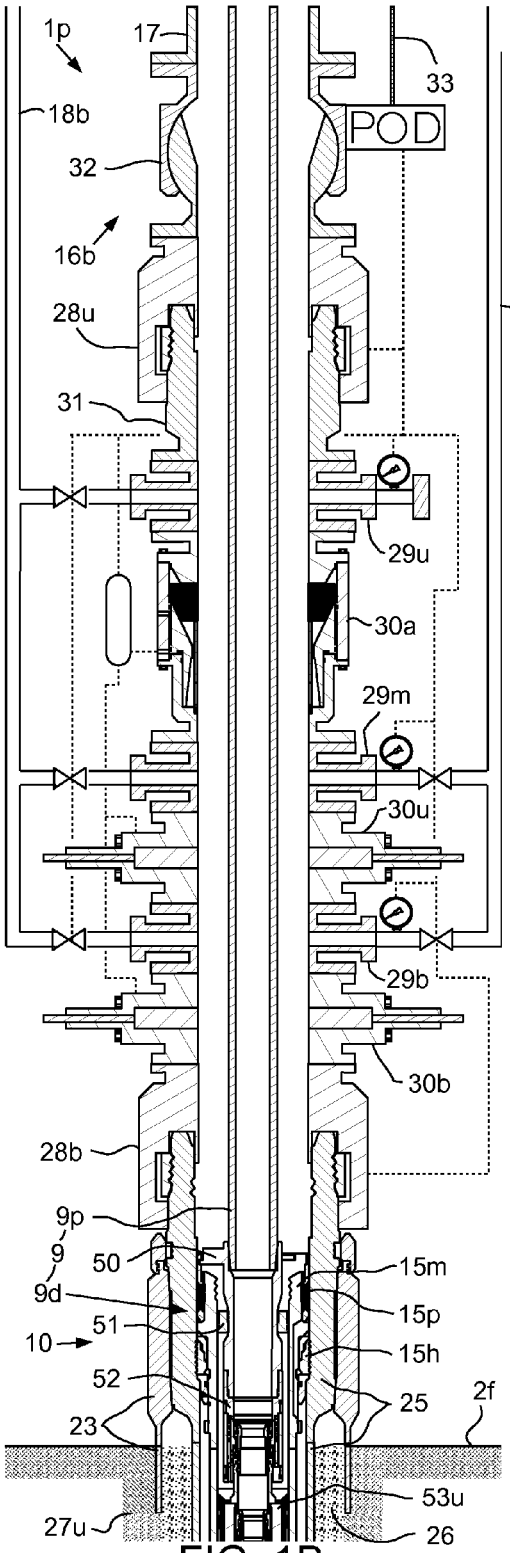
Figure 1C:
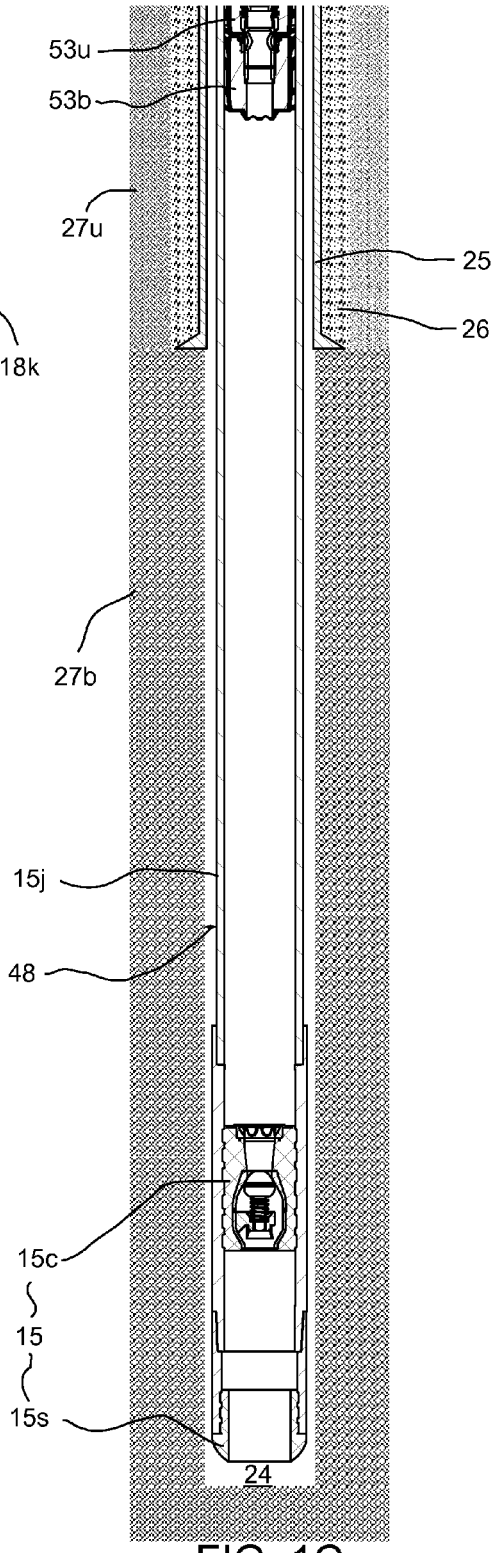

FIGS. 1A-1C illustrate a drilling system 1 in a cement injection mode, according to one embodiment of this disclosure. The drilling system 1 may include a mobile offshore drilling unit (MODU) 1*m*, such as a semi-submersible, a drilling rig 1*r*, a fluid handling system 1*h*, a fluid transport system 1*t*, a pressure control assembly (PCA) 1*p*, and a workstring 9.

The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline 2*s*. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 10.

Alternatively, the MODU may be a drill ship. Alternatively, a fixed offshore drilling unit or a non-mobile floating offshore drilling unit may be used instead of the MODU. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

The drilling rig 1*r* may include a derrick 3, a floor 4*f*, a rotary table 4*t*, a spider 4*s*, a top drive 5, a cementing head 7, and a hoist. The top drive 5 may include a motor for rotating 54 (FIG. 2A) the workstring 9. The top drive motor may be electric or hydraulic. A frame of the top drive 5 may be linked to a rail (not shown) of the derrick 3 for preventing rotation thereof during rotation of the workstring 9 and allowing for vertical movement of the top drive with a traveling block 11*t* of the hoist. The top drive frame may be suspended from the traveling block 11*t* by a drill string compensator 8. The quill may be torsionally driven by the top drive motor and supported from the frame by bearings. The top drive 5 may further have an inlet connected to the frame and in fluid communication with the quill. The traveling block 11*t* may be supported by wire rope 11*r* connected at its upper end to a crown block 11*c*. The wire rope 11*r* may be woven through sheaves of the blocks 11*c,t* and extend to drawworks 12 for reeling thereof, thereby raising or lowering the traveling block 11*t* relative to the derrick 3.

The drill string compensator may 8 may alleviate the effects of heave on the workstring 9 when suspended from the top drive 5. The drill string compensator 8 may be active, passive, or a combination system including both an active and passive compensator. Alternatively, drill string compensator 8 may be disposed between the crown block 11*c* and the derrick 3.

Alternatively, a Kelly and rotary table may be used instead of the top drive.

In the deployment mode, an upper end of the workstring 9 may be connected to the top drive quill, such as by threaded couplings. The workstring 9 may include a casing deployment assembly (CDA) 9*d* and a deployment string, such as such as joints of drill pipe 9*p* connected together, such as by threaded couplings. An upper end of the CDA 9*d* may be connected a lower end of the drill pipe 9*p*, such as by threaded couplings. The CDA 9*d* may be connected to the inner casing string 15, such as by engagement of a bayonet lug with a mating bayonet profile formed in an upper end of the inner casing string 15. The inner casing string 15 may include a packer 15*p*, a casing hanger 15*h*, a mandrel 15*m* for carrying the hanger and packer and having a seal bore formed therein, joints of casing 15*j*, a float collar 15*c*, and a guide shoe 15*s*. The inner casing components may be interconnected, such as by threaded couplings.

Once deployment of the inner casing string 15 has concluded, the workstring 9 may be disconnected from the top drive 5 and the cementing head 7 may be inserted and connected between the top drive 5 and the workstring 9. The cementing head 7 may include an isolation valve 6, an actuator swivel 7*h*, a cementing swivel 7*c*, one or more release plug launchers, such as a first dart launcher 7*a* and a second dart launcher 7*b*, and a control console 7*e*. The isolation valve 6 may be connected to a quill of the top drive 5 and an upper end of the actuator swivel 7*h*, such as by threaded couplings. An upper end of the workstring 9 may be connected to a lower end of the cementing head 7, such as by threaded couplings.

The cementing swivel 7*c* may include a housing torsionally connected to the derrick 3, such as by bars, wire rope, or a bracket (not shown). The torsional connection may accommodate longitudinal movement of the swivel 7*c* relative to the derrick 3. The cementing swivel 7*c* may further include a mandrel and bearings for supporting the housing from the mandrel while accommodating rotation of the mandrel. An upper end of the mandrel may be connected to a lower end of the actuator swivel, such as by threaded couplings. The cementing swivel 7*c* may further include an inlet formed through a wall of the housing and in fluid communication with a port formed through the mandrel and a seal assembly for isolating the inlet-port communication. The cementing mandrel port may provide fluid communication between a bore of the cementing head and the housing inlet. The actuator swivel 7*h* may be similar to the cementing swivel 7*c* except that the housing may have three inlets in fluid communication with respective passages formed through the mandrel. The mandrel passages may extend to respective outlets of the mandrel for connection to respective hydraulic conduits (only one shown) for operating respective hydraulic actuators of the dart launchers 7*a,b*. The actuator swivel inlets may be in fluid communication with a hydraulic power unit (HPU, not shown) operated by the control console 7*e*.

Each dart launcher 7*a,b* may include a body, a diverter, a canister, a latch, and the actuator. Each body may be tubular and may have a bore therethrough. To facilitate assembly, each body may include two or more sections connected together, such as by threaded couplings. An upper end of the top dart launcher body may be connected to a lower end of the actuator swivel 7*h*, such as by threaded couplings and a lower end of the bottom dart launcher body may be connected to the workstring 9. Each body may further have a landing shoulder formed in an inner surface thereof. Each canister and diverter may each be disposed in the respective body bore. Each diverter may be connected to the respective body, such as by threaded couplings. Each canister may be longitudinally movable relative to the respective body. Each canister may be tubular and have ribs formed along and around an outer surface thereof. Bypass passages may be formed between the ribs. Each canister may further have a landing shoulder formed in a lower end thereof corresponding to the respective body landing shoulder. Each diverter may be operable to deflect fluid received from a cement line 14 away from a bore of the respective canister and toward the bypass passages. A release plug, such as a top dart 43*u* or a bottom dart 43*b*, may be disposed in the respective canister bore.

Each latch may include a body, a plunger, and a shaft. Each latch body may be connected to a respective lug formed in an outer surface of the respective launcher body, such as by threaded couplings. Each plunger may be longitudinally movable relative to the respective latch body and radially movable relative to the respective launcher body between a capture position and a release position. Each plunger may be moved between the positions by interaction, such as a jackscrew, with the respective shaft. Each shaft may be longitudinally connected to and rotatable relative to the respective latch body. Each actuator may be a hydraulic motor operable to rotate the shaft relative to the latch body.

Alternatively, the actuator swivel and launcher actuators may be pneumatic or electric. Alternatively, the dart launcher actuators may be linear, such as piston and cylinders.

In operation, when it is desired to launch one of the darts 43*u,b*, the console 7*e* may be operated to supply hydraulic fluid to the appropriate launcher actuator via the actuator swivel 7*h*. The selected launcher actuator may then move the plunger to the release position (not shown). The respective canister and dart 43*u,b* may then move downward relative to the body until the landing shoulders engage. Engagement of the landing shoulders may close the respective canister bypass passages, thereby forcing fluid to flow into the canister bore. The fluid may then propel the respective dart 43*u,b* from the canister bore into a lower bore of the body and onward through the workstring 9.

The fluid transport system it may include an upper marine riser package (UMRP) 16*u*, a marine riser 17, a booster line 18*b*, and a choke line 18*k*. The riser 17 may extend from the PCA 1*p* to the MODU 1*m* and may connect to the MODU via the UMRP 16*u*. The UMRP 16*u* may include a diverter 19, a flex joint 20, a slip (aka telescopic) joint 21, and a tensioner 22. The slip joint 21 may include an outer barrel connected to an upper end of the riser 17, such as by a flanged connection, and an inner barrel connected to the flex joint 20, such as by a flanged connection. The outer barrel may also be connected to the tensioner 22, such as by a tensioner ring.

The flex joint 20 may also connect to the diverter 19, such as by a flanged connection. The diverter 19 may also be connected to the rig floor 4*f*, such as by a bracket. The slip joint 21 may be operable to extend and retract in response to heave 60 (FIG. 3A) of the MODU 1*m* relative to the riser 17 while the tensioner 22 may reel wire rope in response to the heave, thereby supporting the riser 17 from the MODU 1*m* while accommodating the heave. The riser 17 may have one or more buoyancy modules (not shown) disposed therealong to reduce load on the tensioner 22.

The diverter 19 may include an outer housing 19*h* (FIG. 3A), a latch, an actuator, and an inner packer 19*p*. The housing 19*h* may include a plurality of sections connected together and the actuator may be disposed between adjacent sections of the housing and in fluid communication with a actuator hydraulic port formed through a wall of the housing. The actuator may include a resilient ring inwardly displaceable by injection of hydraulic fluid to the actuator port. The packer 19*p* may be releasably connected to the housing by engagement with the latch. The latch may be connected to the housing 19*h* and in fluid communication with a hydraulic latch port formed through the housing wall. The latch may be engaged and disengaged by the application and removal of hydraulic fluid to the latch port. The resilient ring may be engagable with an outer surface of a packing element of the packer 19*p* and may drive the packing element inward into engagement with the drill pipe 9*p*.

The PCA 1*p* may be connected to the wellhead 10 located adjacent to a floor 2*f* of the sea 2. A conductor string 23 may be driven into the seafloor 2*f*. The conductor string 23 may include a housing and joints of conductor pipe connected together, such as by threaded couplings. Once the conductor string 23 has been set, a subsea wellbore 24 may be drilled into the seafloor 2*f* and an outer casing string 25 may be deployed into the wellbore. The outer casing string 25 may include a wellhead housing and joints of casing connected together, such as by threaded couplings. The wellhead housing may land in the conductor housing during deployment of the casing string 25. The outer casing string 25 may be cemented 26 into the wellbore 24. The casing string 25 may extend to a depth adjacent a bottom of the upper formation 27*u*. The wellbore 24 may then be extended into the lower formation 27*b* using a drill string (not shown).

The upper formation 27*u* may be non-productive and a lower formation 27*b* may be a hydrocarbon-bearing reservoir. Alternatively, the lower formation 27*b* may be non-productive (e.g., a depleted zone), environmentally sensitive, such as an aquifer, or unstable.

The PCA 1*p* may include a wellhead adapter 28*b*, one or more flow crosses 29*u,m,b*, one or more blow out preventers (BOPs) 30*a,u,b*, a lower marine riser package (LMRP) 16*b*, one or more accumulators, and a receiver 31. The LMRP 16*b* may include a control pod, a flex joint 32, and a connector 28*u*. The wellhead adapter 28*b*, flow crosses 29*u,m,b*, BOPs 30*a,u,b*, receiver 31, connector 28*u*, and flex joint 32, may each include a housing having a longitudinal bore therethrough and may each be connected, such as by flanges, such that a continuous bore is maintained therethrough. The flex joints 21, 32 may accommodate respective horizontal and/or rotational (aka pitch and roll) movement of the MODU 1*m* relative to the riser 17 and the riser relative to the PCA 1*p*.

Each of the connector 28*u* and wellhead adapter 28*b* may include one or more fasteners, such as dogs, for fastening the LMRP 16*b* to the BOPs 30*a,u,b* and the PCA 1*p* to an external profile of the wellhead housing, respectively. Each of the connector 28*u* and wellhead adapter 28*b* may further include a seal sleeve for engaging an internal profile of the respective receiver 31 and wellhead housing. Each of the connector 28*u* and wellhead adapter 28*b* may be in electric or hydraulic communication with the control pod and/or further include an electric or hydraulic actuator and an interface, such as a hot stab, so that a remotely operated subsea vehicle (ROV) (not shown) may operate the actuator for engaging the dogs with the external profile.

The LMRP 16*b* may receive a lower end of the riser 17 and connect the riser to the PCA 1*p*. The control pod may be in electric, hydraulic, and/or optical communication with a control console 33*c* onboard the MODU 1*m* via an umbilical 33*u*. The control pod may include one or more control valves (not shown) in communication with the BOPs 30*a,u,b* for operation thereof. Each control valve may include an electric or hydraulic actuator in communication with the umbilical 33*u*. The umbilical 33*u* may include one or more hydraulic and/or electric control conduit/cables for the actuators. The accumulators may store pressurized hydraulic fluid for operating the BOPs 30*a,u,b*. Additionally, the accumulators may be used for operating one or more of the other components of the PCA 1*p*. The control pod may further include control valves for operating the other functions of the PCA 1*p*. The control console 33*c* may operate the PCA 1*p* via the umbilical 33*u* and the control pod.

A lower end of the booster line 18*b* may be connected to a branch of the flow cross 29*u* by a shutoff valve. A booster manifold may also connect to the booster line lower end and have a prong connected to a respective branch of each flow cross 29*m,b*. Shutoff valves may be disposed in respective prongs of the booster manifold. Alternatively, a separate kill line (not shown) may be connected to the branches of the flow crosses 29*m,b* instead of the booster manifold. An upper end of the booster line 18*b* may be connected to an outlet of a booster pump 44. A lower end of the choke line 18*k* may have prongs connected to respective second branches of the flow crosses 29*m,b*. Shutoff valves may be disposed in respective prongs of the choke line lower end. An upper end of the choke line 18*k* may be connected to an inlet of a mud gas separator (MGS) 46.

A pressure sensor may be connected to a second branch of the upper flow cross 29*u*. Pressure sensors may also be connected to the choke line prongs between respective shutoff valves and respective flow cross second branches. Each pressure sensor may be in data communication with the control pod. The lines 18*b,c* and umbilical 33*u* may extend between the MODU 1*m* and the PCA 1*p* by being fastened to brackets disposed along the riser 17. Each shutoff valve may be automated and have a hydraulic actuator (not shown) operable by the control pod.

Alternatively, the umbilical may be extended between the MODU and the PCA independently of the riser. Alternatively, the shutoff valve actuators may be electrical or pneumatic.

Figures 2A, 2B, 2C:
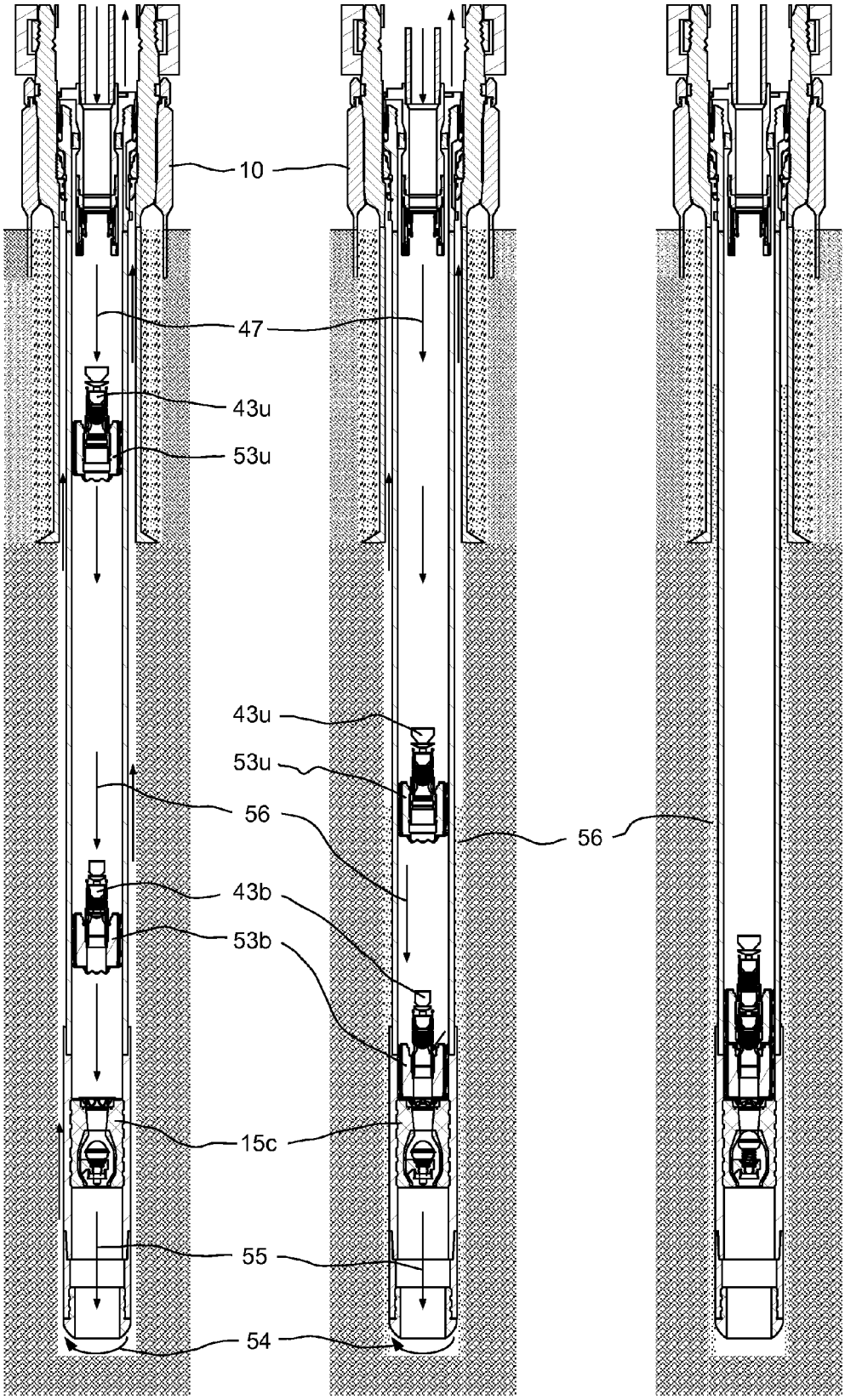
FIGS. 2A-2C illustrate injection of cement slurry into a casing annulus using the drilling system.

The fluid handling system 1*h* may include one or more pumps, such as a cement pump 13, a mud pump 34, and the booster pump 44, a reservoir, such as a tank 35, a solids separator, such as a shale shaker 36, one or more pressure gauges 37*c,k,m,r*, one or more stroke counters 38*c,m*, one or more flow lines, such as cement line 14, mud line 39, and return line 40, one or more shutoff valves 41*k,r*, a cement mixer 42, a well control (WC) choke 45, the MGS 46, and a relief valve 49. In the drilling mode, the tank 35 may be filled with drilling fluid, such as mud (not shown). In the casing deployment mode, the tank 35 may be filled with conditioner 55 (FIG. 2A). In the cement injection mode, the tank 35 may be filled with chaser fluid 47. A booster supply line may be connected to an outlet of the mud tank 35 and an inlet of the booster pump 44. The choke shutoff valve 41*k*, the choke pressure gauge 37*k*, and the WC choke 45 may be assembled as part of the upper portion of the choke line 18*k*.

A first end of the return line 40 may be connected to the diverter outlet and a second end of the return line may be connected to an inlet of the shaker 36. The returns pressure gauge 37*r*, a return shutoff valve 41*r*, and the relief valve 49 may be assembled as part of the return line 40. The relief valve 49 may be pressure operated and have an inlet in fluid communication with a portion of the return line 40 upstream of the return shutoff valve 41*r* and an outlet in fluid communication with a portion of the return line downstream of the shutoff valve 41*r*. A lower end of the mud line 39 may be connected to an outlet of the mud pump 34 and an upper end of the mud line may be connected to the top drive inlet. The mud pressure gauge 37*m* may be assembled as part of the mud line 39. An upper end of the cement line 14 may be connected to the cementing swivel inlet and a lower end of the cement line may be connected to an outlet of the cement pump 13. The cement shutoff valve 41*c* and the cement pressure gauge 37*c* may be assembled as part of the cement line 14. A lower end of a mud supply line may be connected to an outlet of the mud tank 35 and an upper end of the mud supply line may be connected to an inlet of the mud pump 34. An upper end of a cement supply line may be connected to an outlet of the cement mixer 42 and a lower end of the cement supply line may be connected to an inlet of the cement pump 13.

The CDA 9*d* may include a running tool 50, a plug release system 52, 53*u,b*, and a packoff 51. The packoff 51 may be disposed in a recess of a housing of the running tool 50 and carry inner and outer seals for isolating an interface between the inner casing string 15 and the CDA 9*d* by engagement with the seal bore of the mandrel 15*m*. The running tool housing may be connected to a housing of the plug release system 52, 53*u,b*, such as by threaded couplings.

The plug release system 52, 53*u,b* may include an equalization valve 52, a top wiper plug 53*u* and a bottom wiper plug 53*b*. The equalization valve 52 may include a housing, an outer wall, a cap, a piston, a spring, a collet, and a seal insert. The housing, outer wall, and cap may be interconnected, such as by threaded couplings. The piston and spring may be disposed in an annular chamber formed radially between the housing and the outer wall and longitudinally between a shoulder of the housing and a shoulder of the cap. The piston may divide the chamber into an upper portion and a lower portion and carry a seal for isolating the portions. The cap and housing may also carry seals for isolating the portions. The spring may bias the piston toward the cap. The cap may have a port formed therethrough for providing fluid communication between an annulus 48 formed between the inner casing string 15 and the wellbore 24/outer casing string 25 and the chamber lower portion and the housing may have a port formed through a wall thereof for venting the upper chamber portion. An outlet port may be formed by a gap between a bottom of the housing and a top of the cap. As pressure from the annulus 48 acts against a lower surface of the piston through the cap passage, the piston may move upward and open the outlet port to facilitate equalization of pressure between the annulus and a bore of the housing to prevent surge pressure from prematurely releasing one or more of the wiper plugs 53*u,b*.

Each wiper plug 53*u,b* may be made from a drillable material and include a respective finned seal, a plug body, a latch sleeve, and a lock sleeve. Each latch sleeve may have a collet formed in an upper end thereof and the top latch sleeve may have a respective collet profile formed in a lower portion thereof. Each lock sleeve may have a respective seat and seal bore formed therein. Each lock sleeve may be movable between an upper position and a lower position and be releasably restrained in the upper position by a respective shearable fastener. Each dart 43*u,b* may be made from a drillable material and include a respective finned seal and dart body. Each dart body may have a respective landing shoulder and carry a respective landing seal for engagement with the respective seat and seal bore. A major diameter of the bottom landing shoulder may be less than a minor diameter of the top seat such that the bottom dart 43*b* may pass through the top wiper plug 53*u*.

The top shearable fastener may releasably connect the top lock sleeve to the valve housing and the top lock sleeve may be engaged with the valve collet in the upper position, thereby locking the valve collet into engagement with the collet of the top latch sleeve. The bottom shearable fastener may releasably connect the bottom lock sleeve to the top latch sleeve and the bottom lock sleeve may be engaged with the collet of the bottom latch sleeve, thereby locking the collet into engagement with the collet profile of the bottom latch sleeve. The bottom wiper plug 53*b* may include one or more bypass ports formed through a wall of the bottom lock sleeve initially sealed by a burst tube to prevent fluid flow therethrough. The burst tube may be adapted to rupture when a pressure is applied thereto and a rupture pressure of the burst tube may be substantially greater than a release pressure necessary to fracture the bottom shearable fastener of the bottom wiper plug 50*b*.

To facilitate subsequent drill-out, each plug body may further have a portion of an auto-orienting torsional profile formed at a longitudinal end thereof. The top plug body may have the female portion and male portion formed at respective upper and lower ends thereof (or vice versa). The bottom plug body may have only the male portion formed at the lower end thereof.

The float collar 15*c* may include a housing, a check valve, and a body. The body and check valve may be made from drillable materials. The body may have a bore formed therethrough and the torsional profile female portion formed in an upper end thereof for receiving the bottom wiper plug 53*b*. The check valve may include a seat, a poppet disposed within the seat, a seal disposed around the poppet and adapted to contact an inner surface of the seat to close the body bore, and a rib. The poppet may have a head portion and a stem portion. The rib may support a stem portion of the poppet. A spring may be disposed around the stem portion and may bias the poppet against the seat to facilitate sealing. During deployment of the inner casing string 15, the conditioner 55 may be circulated to prepare the annulus 48 for cementing. The conditioner 55 may be pumped down at a sufficient pressure to overcome the bias of the spring, actuating the poppet downward to allow conditioner to flow through the bore of the body.

The guide shoe 15*s* may include a housing and a nose made from a drillable material. The nose may have a rounded distal end to guide the inner casing 15 down into the wellbore 24.

During deployment of the inner casing string 15, the workstring 9 may be lowered by the traveling block 11*t* and the conditioner 55 may be pumped into the workstring bore by the mud pump 34 via the mud line 39 and top drive 5. The conditioner 55 may flow down the workstring bore and the liner string bore and be discharged by the guide shoe 15*s* into the annulus 48. The conditioner 55 may flow up the annulus 48 and exit the wellbore 24 and flow into an annulus formed between the riser 17 and the workstring 9 via an annulus of the LMRP 16*b*, BOP stack, and wellhead 10. The conditioner 55 may exit the riser annulus and enter the return line 40 via an annulus of the UMRP 16*u* and the diverter 19. The conditioner 55 may flow through the return line 40 and into the shale shaker inlet. The conditioner 55 may be processed by the shale shaker 36 to remove any particulates therefrom.

The workstring 9 may be lowered until the inner casing hanger 15*h* seats against a mating shoulder of the subsea wellhead 10. The workstring 9 may continued to be lowered, thereby releasing a shearable connection of the casing hanger 15*h* and driving a cone thereof into dogs thereof, thereby extending the dogs into engagement with a profile of the wellhead 10 and setting the hanger.

FIGS. 2A-2C illustrate injection of cement slurry 56 into the annulus 48 using the drilling system 1. Once the inner casing hanger 15*h* has been set, the inner casing string may be rotated 54 by operation of the top drive 5 (via the workstring 9) and rotation may continue during injection of the cement slurry 56. The bottom dart 43*b* may be released from the first launcher 7*a* by operating the first plug launcher actuator. Cement slurry 56 may be pumped from the mixer 42 into the cementing swivel 7*c* via the valve 41*c* by the cement pump 13. The cement slurry 56 may flow into the second launcher 7*b* and be diverted past the top dart 43*u* via the diverter and bypass passages. The cement slurry 56 may flow into the first launcher 7*a* and be forced behind the bottom dart 43*b* by closing of the bypass passages, thereby propelling the bottom dart into the workstring bore.

Once the desired quantity of cement slurry 56 has been pumped, the top dart 43*u* may be released from the second launcher 7*b* by operating the second plug launcher actuator. The chaser fluid 47 may be pumped into the cementing swivel 7*c* via the valve 41 by the cement pump 13. The chaser fluid 47 may flow into the second launcher 7*b* and be forced behind the bottom dart 43*b* by closing of the bypass passages, thereby propelling the second dart into the workstring bore. Pumping of the chaser fluid 47 by the cement pump 13 may continue until residual cement in the cement line 14 has been purged. Pumping of the chaser fluid 47 may then be transferred to the mud pump 34 by closing the valve 41*c* and opening the valve 6. The train of darts 43*u,b* and cement slurry 56 may be driven through the workstring bore by the chaser fluid 47. The bottom dart 43*b* may reach the bottom wiper plug 53*b* and the landing shoulder and seal of the bottom dart may engage the seat and seal bore of the bottom wiper plug.

Continued pumping of the chaser fluid 47 may increase pressure in the workstring bore against the seated bottom dart 43*b* until the release pressure is achieved, thereby fracturing the bottom shearable fastener. The bottom dart 43*b* and lock sleeve of the bottom wiper plug 53*b* may travel downward until reaching a stop of the bottom wiper plug, thereby freeing the collet of the bottom latch sleeve and releasing the bottom wiper plug from the top wiper plug 53*u*. The released bottom dart 43*b* and bottom wiper plug 53*b* may travel down the bore of the inner casing string 15 wiping the inner surface thereof and forcing the conditioner 55 therethrough. The top dart 43*u* may then reach the top wiper plug 53*u* and the landing shoulder and seal of the top dart may engage the seat and seal bore of the top wiper plug.

Continued pumping of the chaser fluid 47 may increase pressure in the workstring bore against the seated top dart 43*u* until the release pressure is achieved, thereby fracturing the top shearable fastener. The top dart 43*u* and lock sleeve of the top wiper plug 53*u* may travel downward until reaching a stop of the top wiper plug, thereby freeing the collet of the top latch sleeve and releasing the top wiper plug from the equalization valve 52. Continued pumping of the chaser fluid 47 may drive the train of darts 43*u,b*, wiper plugs 53*u,b*, and cement slurry 56 through the inner casing bore until the bottom wiper plug 53*b* bumps the float collar 15*c*.

Continued pumping of the chaser fluid 47 may increase pressure in the inner casing bore against the seated bottom dart 43*b* and bottom wiper plug 53*b* until the rupture pressure is achieved, thereby rupturing the burst tube and opening the bypass ports of the bottom wiper plug. The cement slurry 56 may flow around the bottom dart 43*b* and through the bottom wiper plug 53*b* and the guide shoe 15*s*, and upward into the annulus 48.

Pumping of the chaser fluid 47 may continue to drive the cement slurry 56 into the annulus 48 until the top wiper plug 53*u* bumps the seated bottom wiper plug 53*b*. Pumping of the chaser fluid 47 may then be halted and rotation 54 of the inner casing string 15 may also be halted. The float collar check valve may close in response to halting of the pumping.

Figure 3A:
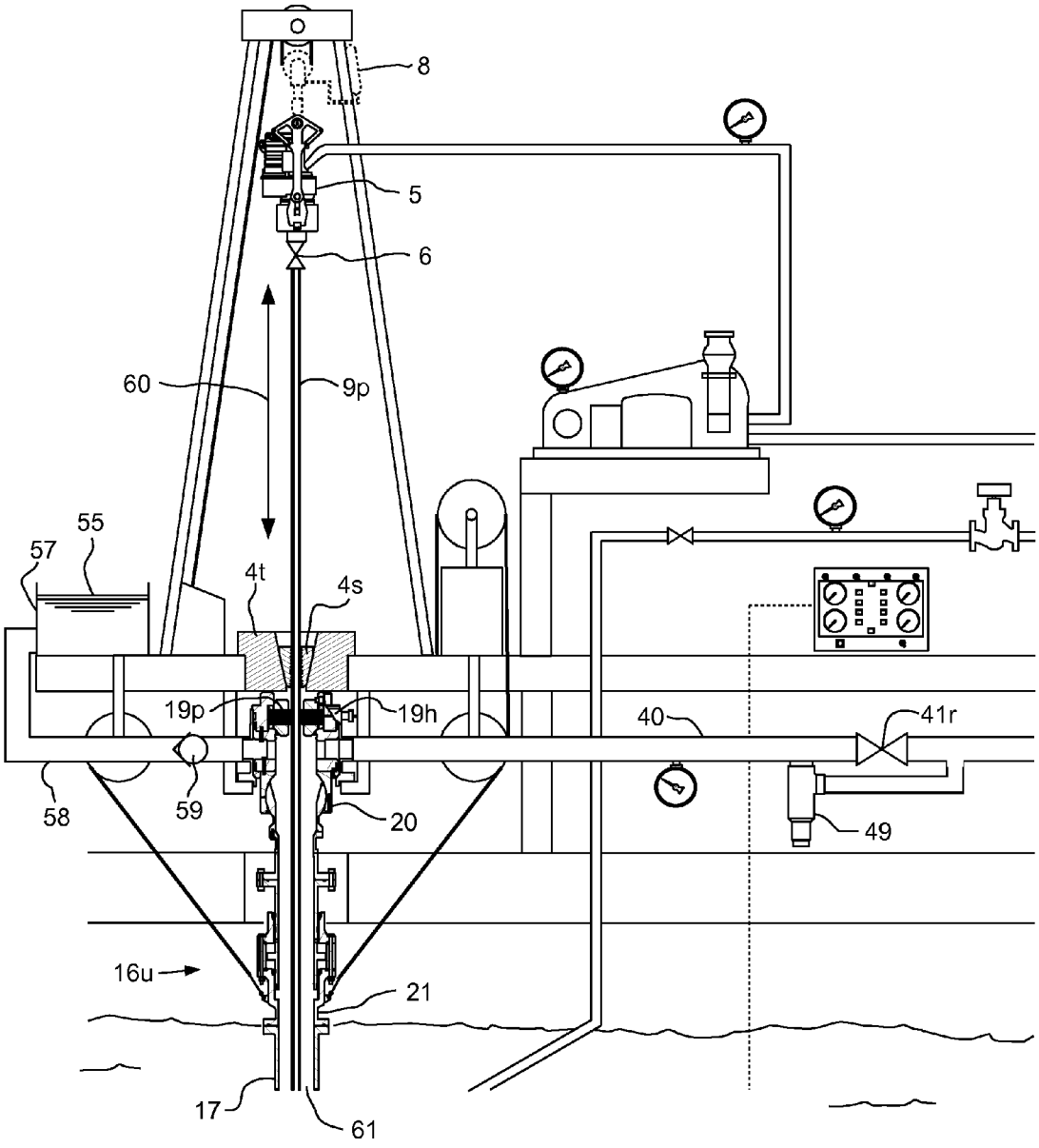
FIGS. 3A-3C illustrate operation of the drilling system in a cement pulsation mode during curing of the cement slurry.
Figure 3B:
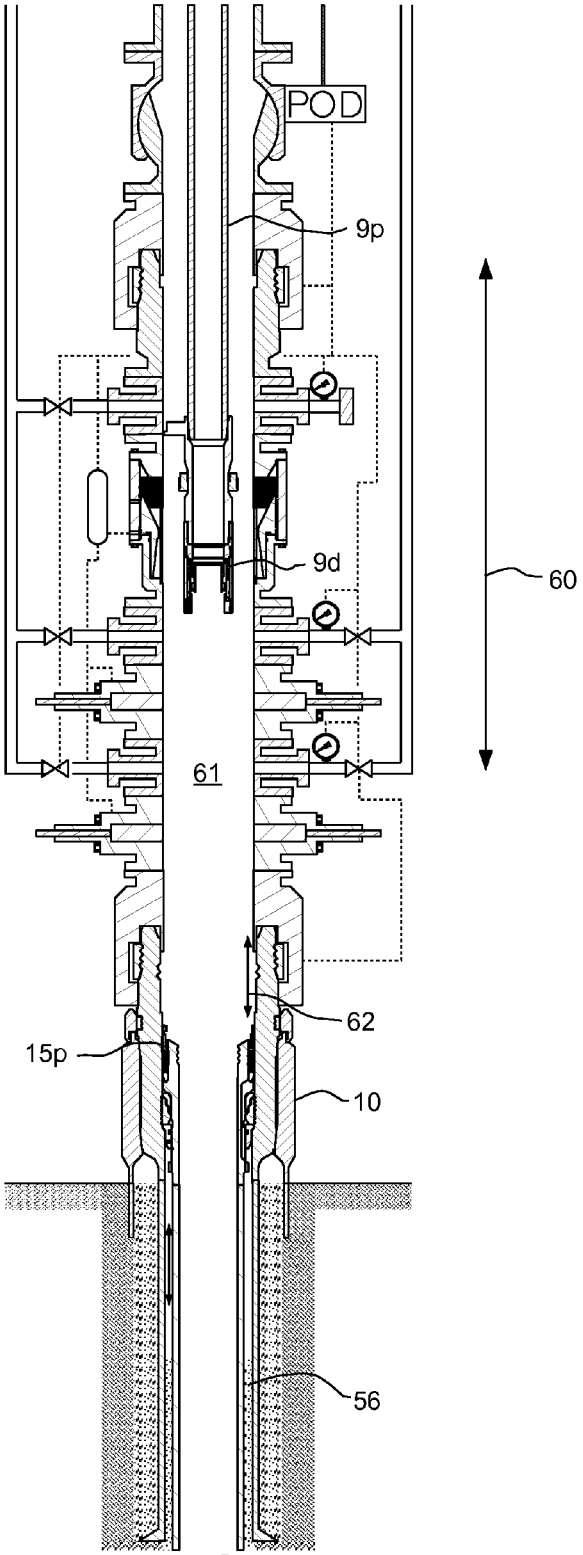
Figure 3C:
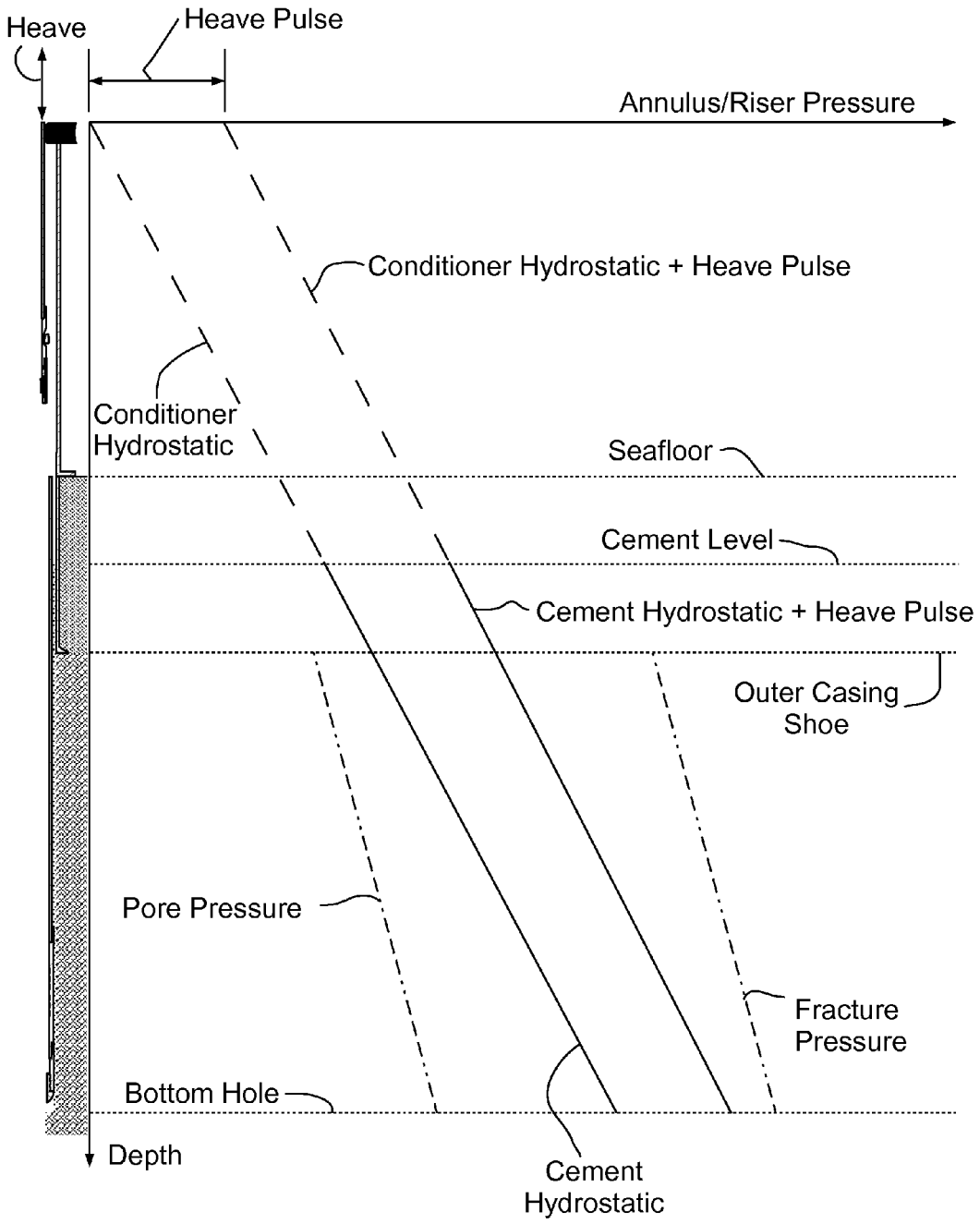

FIGS. 3A-3C illustrate operation of the drilling system 1 in a cement pulsation mode during curing of the cement slurry 56. The bayonet connection between the CDA 9*d* and the inner casing string 15 may be released. The cementing head 7 (minus the isolation valve 6) may be removed and the workstring 9 connected to the isolation valve 6 and raised to create sufficient clearance between the equalization valve 52 and the casing hanger 15*h* to accommodate heave 60 of the workstring 9. The spider 4*s* may then be operated to engage the drill pipe 9*p*, thereby longitudinally supporting the workstring 9 from the rig floor 4*f*. However, once the workstring 9 is supported from the rig floor 4*f*, the drill string compensator 8 can no longer alleviate heaving of the workstring with the MODU 1*m* (depicted by phantom).

A trip tank 57 filled with conditioner 55 may connected to the diverter 19 via spool 58. The spool 58 may have a check valve 59 assembled as part thereof. The check valve 59 may be oriented to allow fluid flow from the trip tank 57 to the diverter 19 and prevent reverse flow from the diverter to the trip tank. The packing element of the diverter 19 may be expanded into engagement with the drill pipe 9*p* by supplying hydraulic fluid to the actuator port thereof. The isolation valve 6 and the return shutoff valve 41*r* may be closed, thereby creating a heave chamber 61. The heave chamber 61 may be closed to contain positive pressure (below a set pressure of the relief valve 49) at an upper portion via the check valve 59, the closed diverter packer 19*p*, the closed return valve 41*r*, and the closed isolation valve 6 and at a lower portion via the top dart 43*u* and top wiper plug 53*u*. The heave chamber 61 may be in fluid communication with the annulus 48 due to the casing packer 15*p* being in the unset position. The conditioner 55 and chaser fluid 47 may each be a liquid or mud. The heave chamber 61 may be purged of any gas present therein such that the heave chamber 61 and annulus 48 are filled with the relatively incompressible conditioner 55, chaser fluid 47, and cement slurry 56.

Alternatively, the workstring or top drive may have a check valve for automatically closing the bore of the workstring instead of the isolation valve.

The workstring 9 and MODU 1*m* may then heave 60 relative to the stationary riser string 17 (due to the slip joint 21), PCA 1*p*, subsea wellhead 10, and inner casing string 15. Heaving 60 of the workstring 9 may include an upward stroke and a downward stroke. Displacement of fluid volume by the drill pipe 9*p* may cause a corresponding surge in pressure of the heave chamber 61 during the downward stroke and a corresponding swab of pressure of the heave chamber during the upward stroke. Addition of the conditioner 55 from the trip tank 57 may negate the swab from the upward stroke of the heave 60, thereby leaving positive pressure pulses 62 from the repeated downward strokes. The pulses 62 may disrupt gelling of the cement slurry 56 and pulsing may continue until the entire column of the cement slurry 56 has thickened sufficiently to prevent gas migration. The thickening time may be predetermined and may range between two and twelve hours, such as four to six hours. The thickening time may be determined empirically by laboratory testing and/or theoretically by computer modeling or provided by the vendor of the cement pre-mixture.

The relief valve 49 may be set at a pressure corresponding to, such as equal to or slightly less than, a maximum allowable pressure of the lower formation 27*b*, such as a fracture pressure thereof, minus the bottomhole pressure generated by the hydrostatic head of the cement slurry 56 plus the hydrostatic head of the conditioner 55 to ensure that the heave pulses 62 do not overpressure the lower formation 27*b*. A magnitude of the pulses 62 may be low compared to the bottomhole pressure, such as less than or equal to one-fifth, one-tenth, or one-twentieth of the bottomhole pressure. In absolute terms, a magnitude of the heave pulses 62 may range from fifty to five hundred psi, such as between eighty and two hundred psi.

Figure 4:
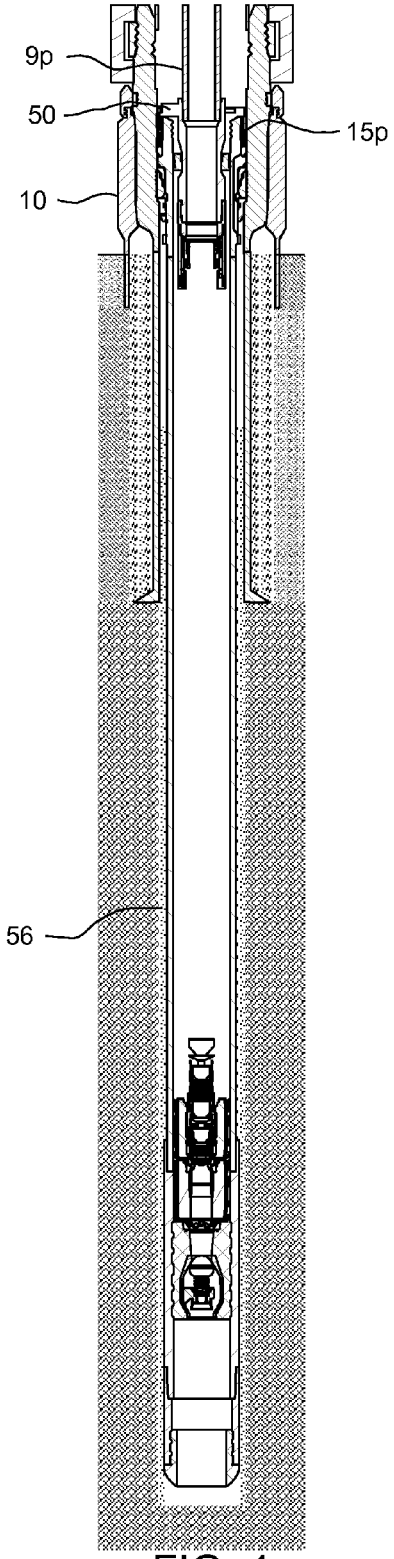
FIG. 4 illustrates completion of the cementing operation.

FIG. 4 illustrates completion of the cementing operation. Once the cement slurry 56 has cured to the thickened state, the spider 4*s* may be operated to release the workstring 9 and the workstring lowered to reengage the CDA 9*d* with the casing hanger 15*h*. The bayonet connection may be reconnected and continued lowering of the workstring 9 may drive a wedge of the casing packer 15*p* into a metallic seal ring thereof, thereby extending the seal ring into engagement with a seal bore of the wellhead 10 and setting the packer. The bayonet connection may be released and the workstring 9 may be retrieved to the rig 1*r*.

Figure 5:
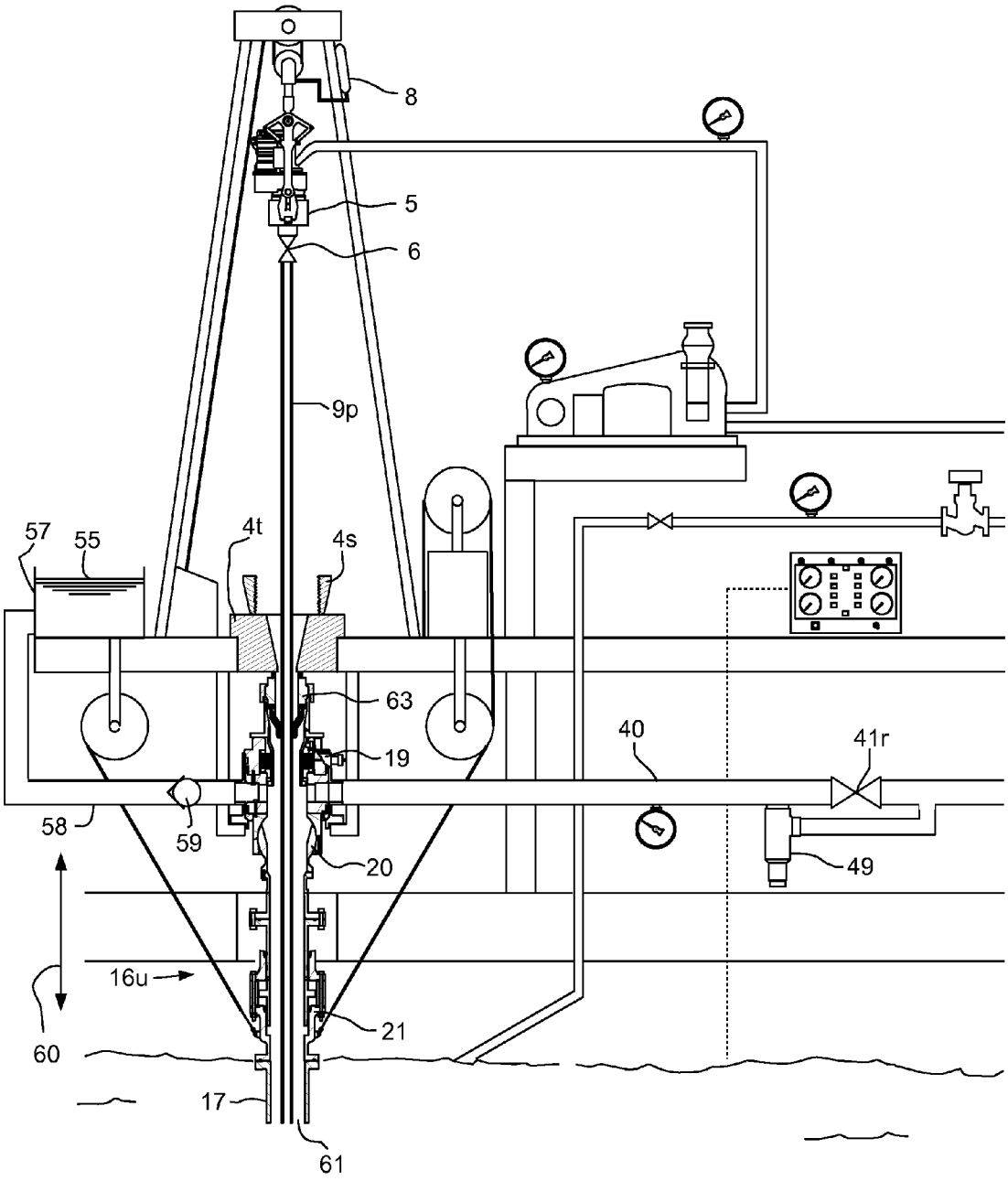
FIG. 5 illustrates operation of a first alternative drilling system in a cement pulsation mode during curing of the cement slurry, according to another embodiment of this disclosure.

FIG. 5 illustrates operation of a first alternative drilling system in a cement pulsation mode during curing of the cement slurry 56, according to another embodiment of this disclosure. The first alternative drilling system may be similar to the drilling system 1 except for modification of the diverter 19 by removing the packer 19*p* from the diverter housing 19*h* and adding a rotating control device (RCD) converter 63 thereto so that the CDA 9*d* may remain engaged to the casing packer 15*p* and the drill string compensator 8 may remain operational during pulsation by the workstring 9 being suspended from the top drive 5. The heave pulses 62 may instead be generated by the heaving 60 of the modified diverter 19*h*, 63, flex joint 20, and the inner barrel of the slip joint 21 relative to the stationary drill pipe 9*p*.

The RCD converter 63 may include a housing having an upper section and lower section. The upper housing section may include a circumferential flange, which may be positioned on the diverter housing. The lower housing section may include a cylindrical insert and an upset ring. The upper housing section may be connected with the lower housing section, such as by threaded couplings. One or more anti-rotation pins may be placed through aligned openings in the threaded connection between the upper and lower housing sections. The upset ring may be connected to the cylindrical insert, such as by threaded couplings. A seal sleeve may be disposed along and around an outer surface of the cylindrical insert and may be disposed between a conical upper portion of the insert and the upset ring. Expansion of the diverter actuator ring against the seal sleeve may both fasten the RCD converter 63 to the diverter housing 19*h* and seal the interface therebetween.

The RCD converter 63 may further include a bearing assembly fastened to the upper housing section, such as by a clamp. The bearing assembly may include an outer sleeve, a dynamic seal, such as a stripper, and a bearing pack. The stripper may include a retainer and a seal. The stripper seal may be directional and oriented to seal against drill pipe 9*p* in response to higher pressure in the UMRP 16*u* than the environment. The stripper seal may have a conical shape for fluid pressure to act against a respective tapered surface thereof, thereby generating sealing pressure against the drill pipe 9*p*. The stripper seal may have an inner diameter slightly less than a pipe diameter of the drill pipe 9*p* to form an interference fit therebetween.

The stripper seal may be flexible enough to accommodate and seal against threaded couplings of the drill pipe 9*p* having a larger tool joint diameter. The drill pipe 9*p* may be received through a bore of the bearing assembly so that the stripper seal may engage the drill pipe 9*p*. The stripper seal may be better suited to withstand the heave of the diverter 19 relative to the drill pipe 9*p* as compared to the packing element of the diverter packer 19*p*. The bearing pack may support the stripper from the outer sleeve such that the strippers may rotate relative to the converter housing. The bearing pack may include one or more radial bearings, one or more thrust bearings, and a self contained lubricant system. The bearing pack may be disposed above the stripper and be housed in and connected to the outer sleeve, such as by threaded couplings and/or fasteners.

Alternatively, for either or both of the drilling system 1 or the first alternative drilling system, immediately after the top wiper plug 53*u* bumps the bottom wiper plug 53*b* and the heave chamber 61 has been created, a shutoff valve of the booster manifold and a shutoff valve of one of the choke prongs may be opened. The booster pump 44 may be operated to pump conditioner 55 down the booster line 18*b* and into the PCA 1*p*. The conditioner 55 may flow from the PCA 1*p* and up the choke line 18*k* and through the WC choke 45. The WC choke 45 may be set to exert a predetermined back pressure on the cement slurry 56 in the annulus 48. Once the back pressure has been achieved, the booster pump 44 may be shut down while closing the shutoff valve of the booster manifold and the shutoff valve of the choke prong, thereby sealing the annulus 48 with the exerted back pressure. The back pressure may protect against U-tubing of the cement slurry 56 and/or dislodgement of the wiper plugs 53*u,b* during heave pulsing of the cement slurry.

Figure 6A:
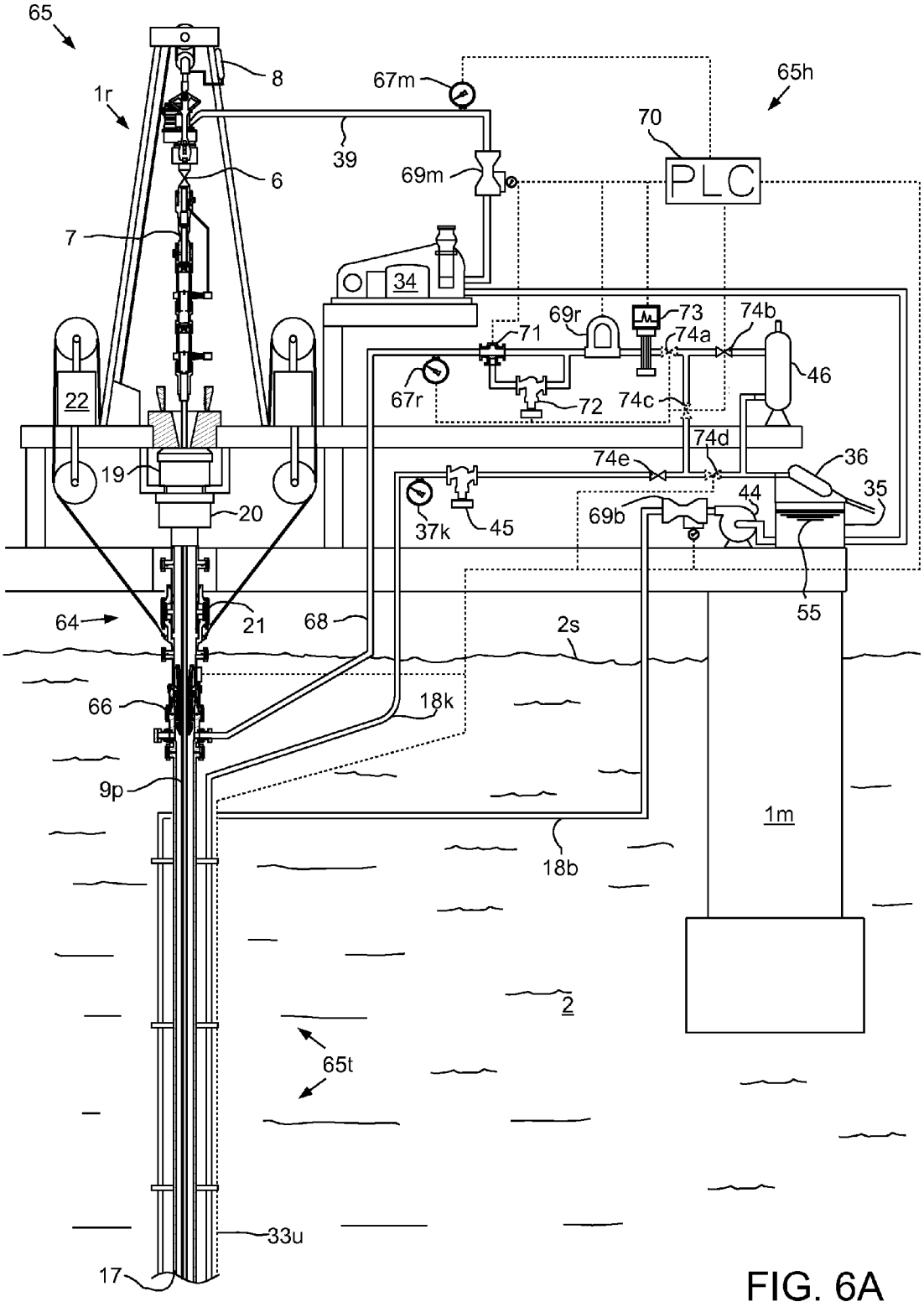
FIGS. 6A-6C illustrate operation of a second alternative drilling system in a cement pulsation mode during curing of the cement slurry, according to another embodiment of this disclosure.
Figure 6B:
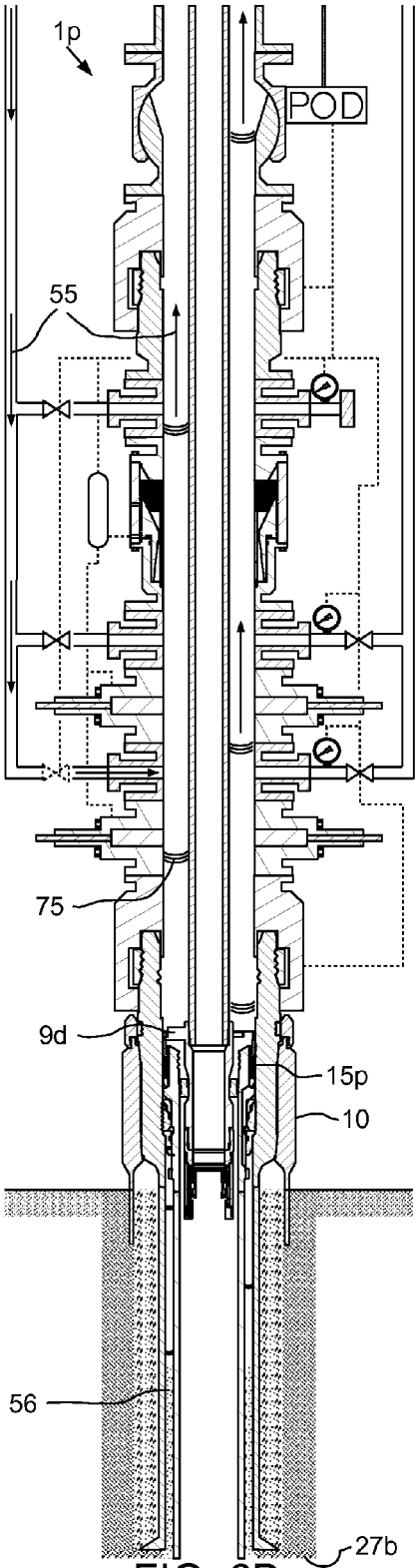
Figure 6C:
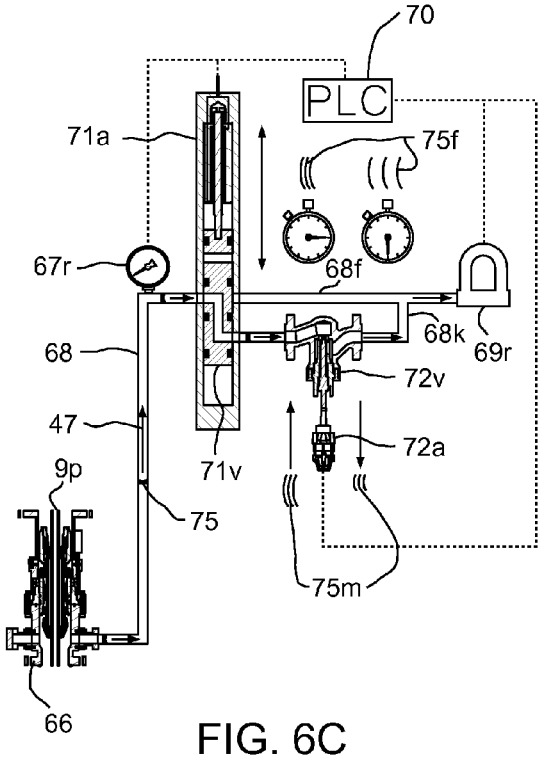

FIGS. 6A-6C illustrate operation of a second alternative drilling system 65 in a cement pulsation mode during curing of the cement slurry 56, according to another embodiment of this disclosure. The drilling system 65 may include the MODU 1*m*, the drilling rig 1*r*, a fluid handling system 65*h*, a fluid transport system 65*t*, the PCA 1*p*, and the workstring 9.

The fluid transport system 65*t* may include an UMRP 64, the marine riser 17, the booster line 18*b*, and the choke line 18*k*. The UMRP 64 may include the diverter 19, the flex joint 20, the slip joint 21, the tensioner 22, and an RCD 66. A lower end of the RCD 66 may be connected to an upper end of the riser 17, such as by a flanged connection. The slip joint outer barrel may be connected to an upper end of the RCD 66, such as by a flanged connection.

The RCD 66 may include a docking station and a bearing assembly. The docking station may be submerged adjacent the waterline 2*s*. The docking station may include a housing, a latch, and an interface. The RCD housing may be tubular and have one or more sections connected together, such as by flanged connections. The RCD housing may have one or more fluid ports formed through a lower housing section and the docking station may include a connection, such as a flanged outlet, fastened to one of the ports.

The latch may include a hydraulic actuator, such as a piston, one or more fasteners, such as dogs, and a body. The latch body may be connected to the housing, such as by threaded couplings. A piston chamber may be formed between the latch body and a mid housing section. The latch body may have openings formed through a wall thereof for receiving the respective dogs. The latch piston may be disposed in the chamber and may carry seals isolating an upper portion of the chamber from a lower portion of the chamber. A cam surface may be formed on an inner surface of the piston for radially displacing the dogs. The latch body may further have a landing shoulder formed in an inner surface thereof for receiving a protective sleeve (not shown) or the bearing assembly.

Hydraulic passages may be formed through the mid housing section and may provide fluid communication between the interface and respective portions of the hydraulic chamber for selective operation of the piston. An RCD umbilical may have hydraulic conduits and may provide fluid communication between the RCD interface and a HPU (not shown). The RCD umbilical may further have an electric cable for providing data communication between a control console (not shown) and the RCD interface via a controller.

The bearing assembly may include a catch sleeve, one or more dynamic seals, such as strippers, and a bearing pack. Each stripper may include a gland or retainer and a seal. Each stripper seal may be directional and oriented to seal against drill pipe 9*p* in response to higher pressure in the riser 17 than the UMRP 64. Each stripper seal may have a conical shape for fluid pressure to act against a respective tapered surface thereof, thereby generating sealing pressure against the drill pipe 9*p*. Each stripper seal may have an inner diameter slightly less than a pipe diameter of the drill pipe 9*p* to form an interference fit therebetween. Each stripper seal may be flexible enough to accommodate and seal against threaded couplings of the drill pipe 9*p* having a larger tool joint diameter. The drill pipe 9*p* may be received through a bore of the bearing assembly so that the stripper seals may engage the drill pipe 9*p*. The stripper seals may provide a desired barrier in the riser 17 either when the drill pipe 9*p* is stationary, rotating, or heaving.

The catch sleeve may have a landing shoulder formed at an outer surface thereof, a catch profile formed in an outer surface thereof, and may carry one or more seals on an outer surface thereof. Engagement of the latch dogs with the catch sleeve may connect the bearing assembly to the docking station. The gland may have a landing shoulder formed in an inner surface thereof and a catch profile formed in an inner surface thereof for retrieval by a bearing assembly running tool. The bearing pack may support the strippers from the catch sleeve such that the strippers may rotate relative to the docking station. The bearing pack may include one or more radial bearings, one or more thrust bearings, and a self contained lubricant system. The bearing pack may be disposed between the strippers and be housed in and connected to the catch sleeve, such as by threaded couplings and/or fasteners.

Alternatively, the bearing assembly may be non-releasably connected to the housing. Alternatively, the RCD may be located above the waterline and/or along the UMRP at any other location besides a lower end thereof. Alternatively, the RCD may be assembled as part of the riser at any location therealong or as part of the PCA. Alternatively, an active seal RCD may be used instead.

The fluid handling system 65*h* may include the cement pump (not shown), the mud pump 34, the fluid tank 35, the shale shaker 36, the pressure gauge 37*k*, the cement line (not shown), the mud line 39, the cement mixer (not shown), the booster pump 44, the WC choke 45, the MGS 46, one or more pressure sensors 67*m,r*, a return line 68, one or more flow meters 69*b,m,r*, a toggle valve 71, an automated variable choke valve, such as a managed pressure (MP) choke 72, a gas detector 73, and one or more shutoff valves 74*a-e*.

The mud line 39 may have the flow meter 69*m* and the pressure sensor 67*m* assembled as part thereof. An upper end of the booster line 18*b* may have the flow meter 69*b* assembled as part thereof. A lower end of the return line 68 may be connected to an outlet of the RCD 66 and an upper end of the return line may be connected to a first flow tee. The returns pressure sensor 67*r*, the toggle valve 71, the MP choke 72, the returns flow meter 69*r*, the gas detector 73, and the first shutoff valve 74*a* may be assembled as part of the return line 68. An upper end of the choke line 18*k* may be connected to a second flow tee and the pressure gauge 37*k*, WC choke 45, and the fifth shutoff valve 74*e* may be assembled as part thereof. A crossover spool may connect the first and second tees and have the fourth shutoff valve 74*d* assembled as part thereof. An MGS spool may connect the first tee and an inlet of the MGS 46 and have the second shutoff valve 74*b* assembled as part thereof. A shaker spool may connect the second tee to an inlet of the shaker 36 and have the fourth shutoff valve 74*d* and a third flow tee assembled as part thereof. A splice line may connect the third tee to a liquid outlet of the MGS 46.

Each pressure sensor 67*m,r* may be in data communication with a programmable logic controller (PLC) 70. The returns flow meter 69*r* may be a mass flow meter, such as a Coriolis flow meter, and may be in data communication with the PLC 70. The returns flow meter 69*r* may be operable to monitor a flow rate of return fluid (drilling returns or conditioner 55, depending on the operation being conducted). Each of the flow meters 69*b,m* may be a volumetric flow meter, such as a Venturi flow meter, and may be in data communication with the PLC 70. The flow meter 69*m* may be operable to monitor a flow rate of the mud pump 34. The flow meter 69*b* may be operable to monitor a flow rate of the booster pump 44. The PLC 70 may have a density measurement of the conditioner 55 or chaser fluid 47 to determine a mass flow rate of the particular fluid from the volumetric measurement of the flow meters 69*b,m*.

Alternatively, a stroke counter may be used to monitor a flow rate of the mud pump and/or booster pump instead of the volumetric flow meters. Alternatively, either or both of the volumetric flow meters may be mass flow meters.

The gas detector 73 may be operable to extract a gas sample from the return fluid to detect contamination by formation fluid (not shown) and analyze the captured sample to detect hydrocarbons and/or non-hydrocarbon components of the sample. The gas detector 73 may include a body, a probe, a chromatograph, and a carrier/purge system. The carrier/purge system may be connected to the probe and a carrier gas may be injected into the probe inlet to displace sample gas trapped therein. The carrier/purge system may then transport the sample gas to the chromatograph for analysis. The carrier purge system may also be routinely run to purge the probe of condensate. The chromatograph may be in data communication with the PLC 70 to report the analysis of the sample.

The return line 68 may further include a fourth flow tee, a bypass splice line 68*f*, and a choke splice line 68*k* assembled as part thereof. The bypass splice line 68*f* may connect a first outlet of the toggle valve 71 to the fourth flow tee and the choke splice line 68*k* may connect the a second outlet of the toggle valve to the fourth flow tee and have the MP choke 72 assembled as part thereof. The MP choke 72 may include a valve 72*v* and a hydraulic actuator 72*a* operated by the PLC 70 via an HPU to generate pulses 75 during curing of the cement slurry 56.

The toggle valve 71 may include a housing, a valve member 71*v*, and a linear actuator 71*a* for moving the valve member between an upper position and a lower position. The housing may have an inlet and the first and second outlets formed through a wall thereof. The linear actuator 71*a* may be fast acting, such as a solenoid having a shaft connected to the valve member 71*v* and a coil for longitudinally driving the shaft relative to the housing between the upper and lower positions. The valve member 71*v* may carry seals (four shown) on an outer surface thereof for selectively opening and closing the housing outlets. The valve member 71*v* may have a first passage formed therethrough for opening the first outlet and a second passage formed therethrough for opening the second outlet. The first passage may be straight and straddled by the first and second seals and the second passage may be z-shaped and have an upper portion straddled by the second and third seals and a lower portion straddled by the third and fourth seals. In the upper position, the z-passage may be aligned with the inlet and second outlet while the straight passage is closed and in the lower position, the straight passage may be aligned with the inlet and first outlet while the z-passage is closed.

The MP choke 72 may be employed during drilling of the lower formation 27*b*. The PLC 70 may periodically increase the bottomhole pressure (BHP) to a test pressure including the hydrostatic pressure of the cement slurry and the desired pulse pressure to verify integrity of the lower formation 27*b*. The PLC 70 may increase the BHP to the test pressure by tightening the MP choke 72. Should the lower formation 27*b* withstand the expected pressure, then the cementing operation may proceed as planned. Should drilling returns leak into the lower formation 27*b* (detected by monitoring the returns flow meter 69*r*) during the test, then the cementing operation may have to be modified, such as by decreasing a magnitude 75*m* of the planned pulses 75 and/or modifying properties of the planned cement slurry 56.

During injection of the cement slurry 56, the MP choke 72 may be bypassed. The PLC 70 may perform a mass balance using the flow meters 69*m* and 69*r* to ensure that no fluid has been lost to the lower formation 27*b* or fluid from the lower formation has entered the annulus 48. The PLC 70 may also determine the cement level in the annulus 48.

Once injection of the cement slurry 56 has finished, a shutoff valve of the booster manifold may be opened and the booster pump 44 operated to pump conditioner 55 down the booster line 18*b* and into the PCA 1*p*. The conditioner 55 may flow up the LMRP annulus and riser annulus to the RCD 66. The conditioner 55 may be diverted by the RCD stripper seals into the return line 68. The conditioner 55 may flow through the toggle valve 71, the bypass splice line 68*f*, the returns flow meter 69*r*, the gas detector 73, the open first shutoff valve 74*a*, the crossover spool and open third shutoff valve 74*c*, and the shaker spool and open fourth shutoff valve 74*d* into the shale shaker inlet.

As the conditioner 55 is circulated through the closed loop, the PLC 70 may periodically reciprocate the toggle valve 71 to the upper position for diverting flow through the MP choke 72 and then back to the lower position to restore flow to the bypass splice line 68*f*, thereby generating the choke pulse 75. The choke pulses 75 may be generated at a relatively low frequency 75*f*, such as one pulse every fifteen seconds, thirty seconds, forty-five seconds, sixty seconds, seventy-five seconds, or ninety seconds (or any frequency therebetween). The pulse magnitude 75*m* may be any of the magnitudes discussed above for the heave pulse 62. The PLC 70 may control the pulse magnitude 75*m* by adjusting a position of the MP choke 75*m* and monitoring the returns pressure sensor 67*r* for feedback.

Circulation of the conditioner 55 and pulse generation may be maintained until the entire column of the cement slurry 56 has thickened sufficiently to prevent gas migration. As the conditioner 55 is being circulated, the PLC 70 may perform a mass balance between entry and exit of the conditioner into/from the wellhead 10 to monitor for formation fluid entering the annulus 48 or cement slurry 56 entering the lower formation 27*b* using the flow meters 69*b,r*. An injection rate of the booster pump 44 may be increased in response to detection of formation fluid entering the annulus 48 and the PLC 70 may relax the MP choke 72 in response to cement slurry 56 entering the lower formation 27*b*. The CDA 9*d* may remain engaged to the casing packer 15*p* and the drill string compensator 8 may remain operational during pulsation. Once the cement slurry 56 has cured to the thickened state, casing packer 15*h* may be set and the workstring 9 retrieved to the rig 1*r*.

Alternatively, the conditioner may be circulated by an auxiliary pump connected to an inlet of the RCD instead of the booster pump. Alternatively, the RCD may be omitted, the annular BOP 30*a* closed against an outer surface of the drill pipe, and one of the choke line prongs opened as part of the closed circulation loop of the conditioner. Further in this alternative, the bypass splice line, choke splice line and toggle valve may be installed as part of the choke line 18*k* and the WC choke 45 used to generate the choke pulses.

The PLC 70 may keep a cumulative record during the cementing and pulsing operation of any fluid ingress/egress events and the PLC may make an evaluation as to the acceptability of the cured cement. The PLC 70 may also include a comparison of the actual cement level to the planned cement level in the evaluation. Should the PLC 70 determine that the cured cement is unacceptable, the PLC may make recommendations for remedial action, such as a cement bond/evaluation log and/or a secondary cementing operation.

Figure 7A:
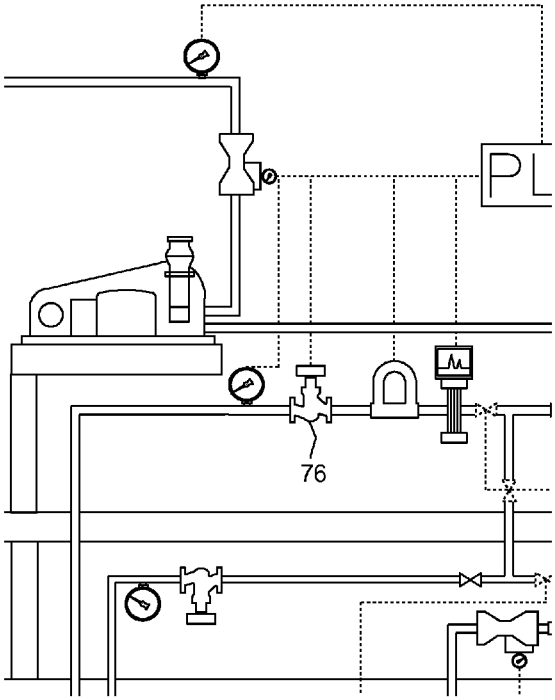
FIGS. 7A-7C illustrate operation of a third alternative drilling system in a cement pulsation mode during curing of the cement slurry, according to another embodiment of this disclosure.
Figure 7B:
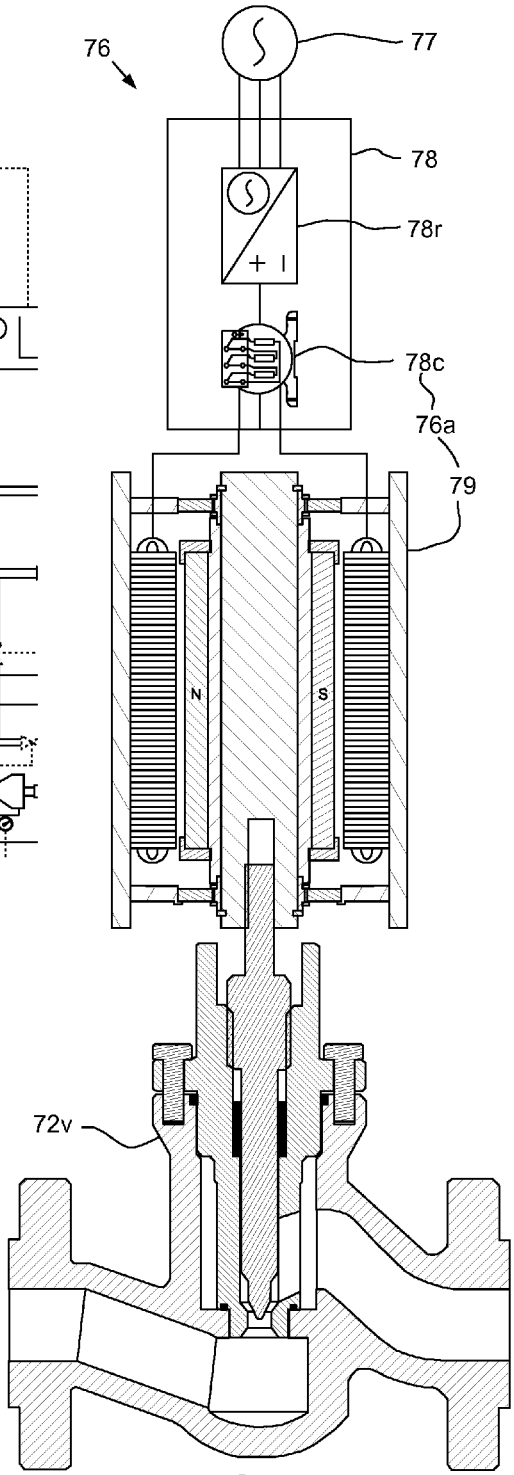
Figure 7C:
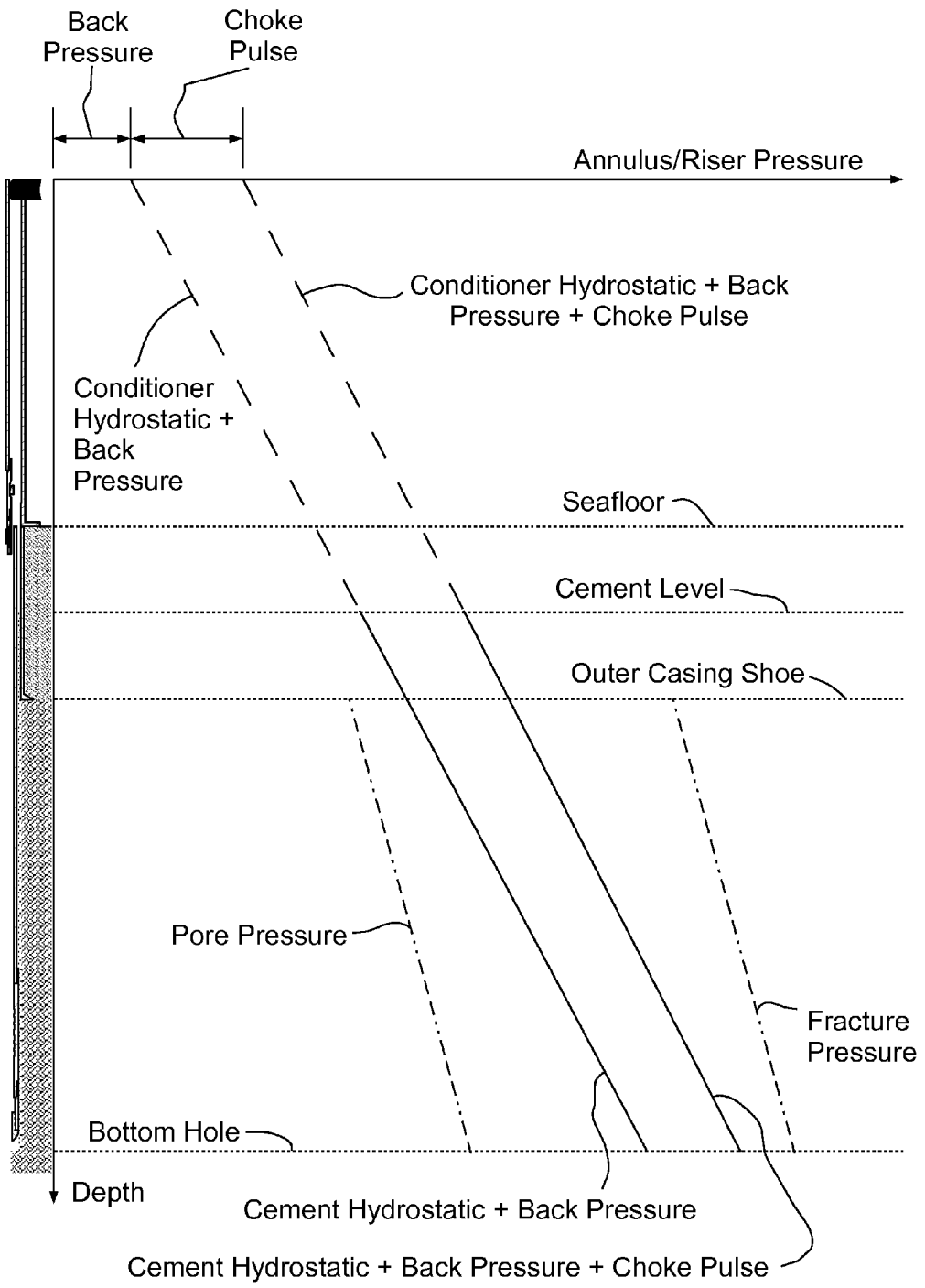

FIGS. 7A-7C illustrate operation of a third alternative drilling system in a cement pulsation mode during curing of the cement slurry 56, according to another embodiment of this disclosure. The third alternative drilling system may be similar to the second alternative drilling system 65 except that a fast acting choke 76 has replaced the toggle valve 71 and the MP choke 72.

The fast acting choke 76 may include an electric actuator, such as a servomotor 76*a*, and the valve 72*v*. The valve 72*v* may include a body, a bonnet fastened to the body, such as by threaded fasteners, a stem linked to the bonnet, such as by a lead screw, a packing sealing an interface between the stem and the bonnet, a gasket, and a seal. The body may have an inlet and outlet formed at respective longitudinal ends thereof, a chamber formed at a mid portion thereof for receiving the bonnet, and a passage connecting the inlet, outlet, and chamber. The bonnet may have a Venturi formed in an inner surface of a lower end thereof, a seal shoulder formed in an outer surface thereof adjacent to the lower end, and a discharge port formed through a wall thereof. The body may have a landing shoulder formed in an inner surface thereof adjacent to the chamber. The stem may have a flow bean formed at a lower end thereof for selectively throttling the Venturi. The stem and Venturi may be made from an erosion resistant material. The stem may have a torsional coupling formed at an upper end thereof for rotary driving by the servomotor.

The servomotor 76*a* may include a driver 78 and a motor 79. The motor 79 may include a rotor, a stator, and a pair of bearings supporting the rotor for rotation relative to the stator. The rotor may include a hub made from a magnetically permeable material, a plurality of permanent magnets torsionally connected to the hub, and a shaft. The rotor may include one or more pairs of permanent magnets having opposite polarities. The magnets may also be fastened to the hub, such as by retainers. The hub may be torsionally connected to the shaft and fastened thereto. The stator may include a housing, a core, and a plurality of windings, such as three (only two shown). The core may include a stack of laminations made from an electrically permeable material. The stack may have lobes formed therein, each lobe for receiving a respective winding. The core may be longitudinally and torsionally connected to the housing, such as by an interference fit.

Alternatively, the motor 79 may be a switched reluctance motor instead of a brushless permanent magnet motor.

The motor driver 78 may include a rectifier 78*r*, a motor controller 78*c*, and a rotor position sensor (not shown). The motor driver 78 may receive a three phase alternating current (AC) power signal from a generator 40 of the MODU 1*m*. The rectifier 78*r* may convert the three phase AC power signal to a direct current (DC) power signal and supply the converted DC power signal to the motor controller 78*c*. The motor controller 78*c* may have an output for each phase (i.e., three) of the motor 10 and may monitor may modulate the DC power signal to drive each phase winding of the stator based on signals received from the rotor position sensor.

The fast acting choke 76 may impart the capability to the third alternative drilling system to exert back pressure during injection and pulsing of the cement slurry 56 such that a density of the cement slurry 56 may correspond to a minimum allowable pressure gradient, such as pore pressure gradient, of the lower formation 27*b*. As the conditioner 55 is circulated, the PLC 70 may periodically reciprocate the choke 76 from a looser position, where only back pressure is exerted on the conditioner 55 to a tighter position and then back to the looser position, thereby generating the choke pulse 75 in addition to the back pressure. The PLC 70 may also perform the mass balance during injection of the cement slurry 56 and during circulation of the conditioner 55 for pulsing to evaluate acceptability, as discussed above. The PLC 70 may relax the fast acting choke 76 if fluid loss is detected during injection of the cement slurry 56 and relax the tighter position if fluid loss is detected during pulsing. The PLC 70 may tighten the fast acting choke 76 if formation fluid is detected during injection of the cement slurry 56 and tighten the looser position if formation fluid is detected during pulsing.

Alternatively, a second MP choke may be added to the bypass splice line 68*f* of the second alternative drilling system 65 to achieve back pressure capability by setting the first MP choke to generate the back pressure plus the choke pulse and the second MP choke to generate only the back pressure.

FIGS. 8A-8G illustrate operation of a fourth alternative drilling system 80 in a cement pulsation mode during curing of the cement slurry 56, according to another embodiment of this disclosure. The drilling system 80 may include the MODU 1*m*, the drilling rig 1*r*, a fluid handling system 80*h*, a fluid transport system 80*t*, the PCA 1*p*, and the workstring 9. The fluid transport system 80*t* may include an UMRP 80*u*, the marine riser 17, the booster line 18*b*, and the choke line 18*k*. The UMRP 80*u* may include the diverter 19, the flex joint 20, the slip joint 21, the tensioner 22, an RCD 66, a heave sensor 82, and a heave relief system 81.

The heave sensor 82 may be installed in the slip joint 21 and be in data communication with the PLC 70. The heave sensor 82 may be a linear variable differential transformer (LVDT) having an outer portion mounted in the outer barrel and a ferromagnetic target ring mounted on a shoulder of the inner barrel. The outer portion may include a central primary coil and a pair of secondary coils straddling the primary coil. The primary coil may be driven by an AC signal and the secondary coils monitored for response signals which may vary in response to a position of the target ring relative to the outer portion.

The heave relief system 81 may include a relief vessel 81*a* and a flow line connecting the relief vessel to an outlet of the RCD 66. A pressure sensor 81*p* and a shutoff valve 81*v* may be assembled as part of the relief line. The shutoff valve 81*v* and pressure sensor 81*p* may be in communication with the PLC 70. The shutoff valve 81*v* may be normally closed unless the PLC 70 detects the occurrence of a rogue wave. In such an event, the PLC 70 may open the shutoff valve 81*v* to allow the fluid displaced by the drill pipe 9*p* to be relieved to the vessel 81*a* to avoid overpressuring the lower formation 27*b*.

The fluid handling system 80*h* may include the cement pump (not shown), the mud pump 34, the fluid tank 35, the shale shaker 36, the pressure gauge 37*k*, the cement line (not shown), the mud line 39, the cement mixer (not shown), the booster pump 44, the WC choke 45, the MGS 46, the pressure sensors 67*m,r*, a return line 83, the flow meters 69*b,m,r*, the fast acting choke 76, the gas detector 73, the shutoff valves 74*a-e*, and a hydraulic circuit 84. A lower end of the return line 83 may be connected to an outlet of the RCD 66 and an upper end of the return line may be connected to the first flow tee. The returns pressure sensor 67*r*, the fast acting choke 76, the returns flow meter 69*r*, the gas detector 73, the first shutoff valve 74*a*, and fourth and fifth flow tees may be assembled as part of the return line 83.

The hydraulic circuit 84 may include the check valve 59, a compensator toggle valve 71, an intensifier choke 72, a compensation spool 84*c*, a discharge line 84*d*, a pulse spool 84*p*, a loop spool 84*r*, a supply line 84*s*, an input spool 84*t*, a fluid tank 85 filled with conditioner 55, an auxiliary pump 86, a fast acting pulse shutoff valve 87, a pulse flow meter 88*p*, and a compensator flow meter 88*c*. The supply line 84*s* may connect an outlet of the tank 85 with an inlet of the auxiliary pump 86. The discharge line 84*d* may connect an outlet of the auxiliary pump 86 and a sixth flow tee.

The input spool 84*t* may connect the sixth flow tee to an inlet of the compensator valve 71 and have the intensifier choke 72 may be assembled as part thereof. The compensator spool 84*c* may connect a first outlet of the compensator valve 71 to the fifth tee and have the check valve 59 and compensator flow meter 88*c* assembled as part thereof. The check valve 59 may be oriented to allow flow from the compensator valve 71 to the return line 83 and prevent reverse flow from the return line 83 to the compensator valve 71. The loop spool 84*r* may connect a second outlet of the compensator valve 71 to an inlet of the fluid tank 85. The pulse spool 84*p* may connect the sixth tee to the fourth tee of the return line 83 and have the pulse valve 87 and the pulse flow meter 88*p* assembled as part thereof.

Figure 8A:
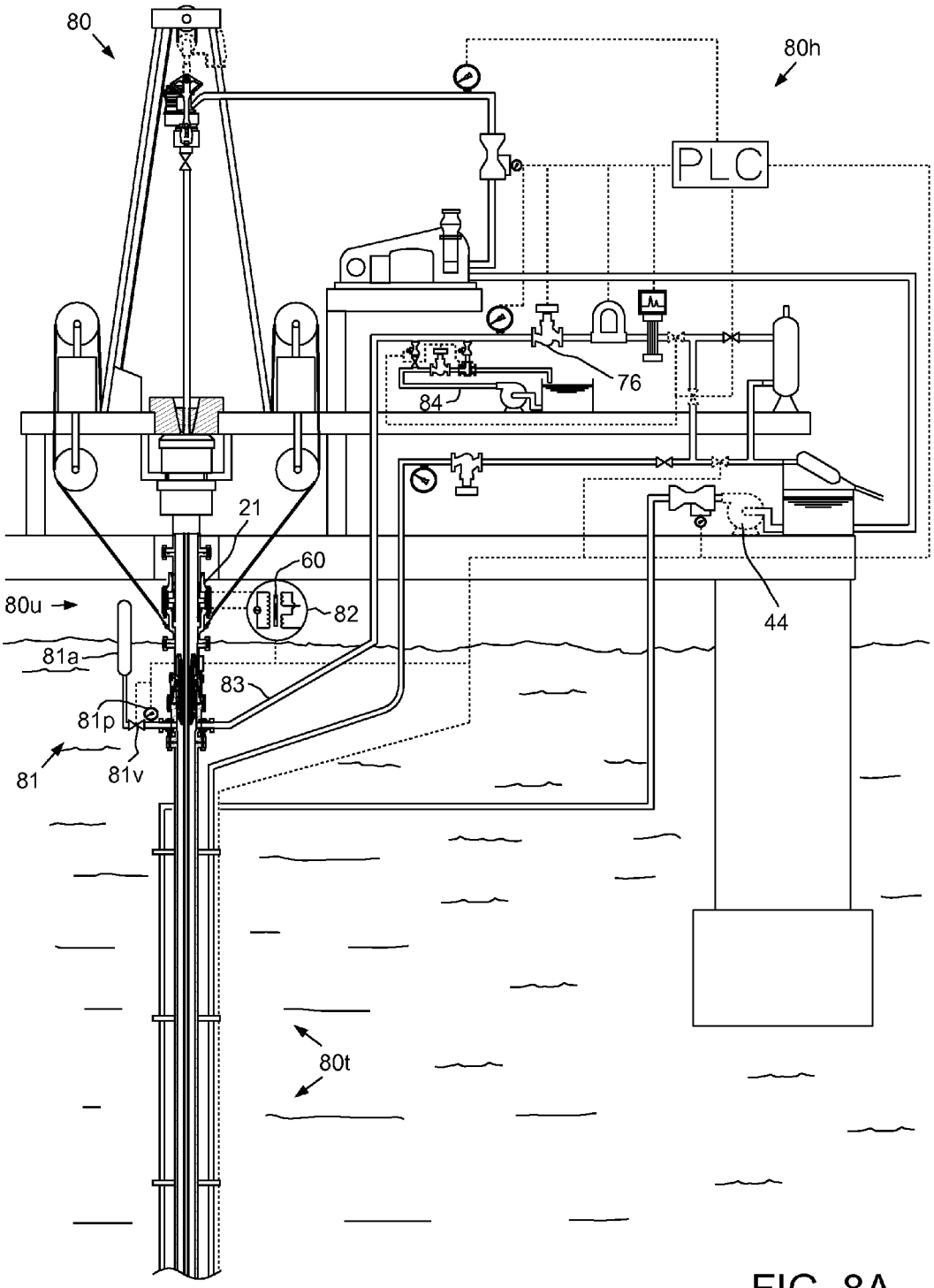
FIGS. 8A-8G illustrate operation of a fourth alternative drilling system in a cement pulsation mode during curing of the cement slurry, according to another embodiment of this disclosure.
Figure 8B:
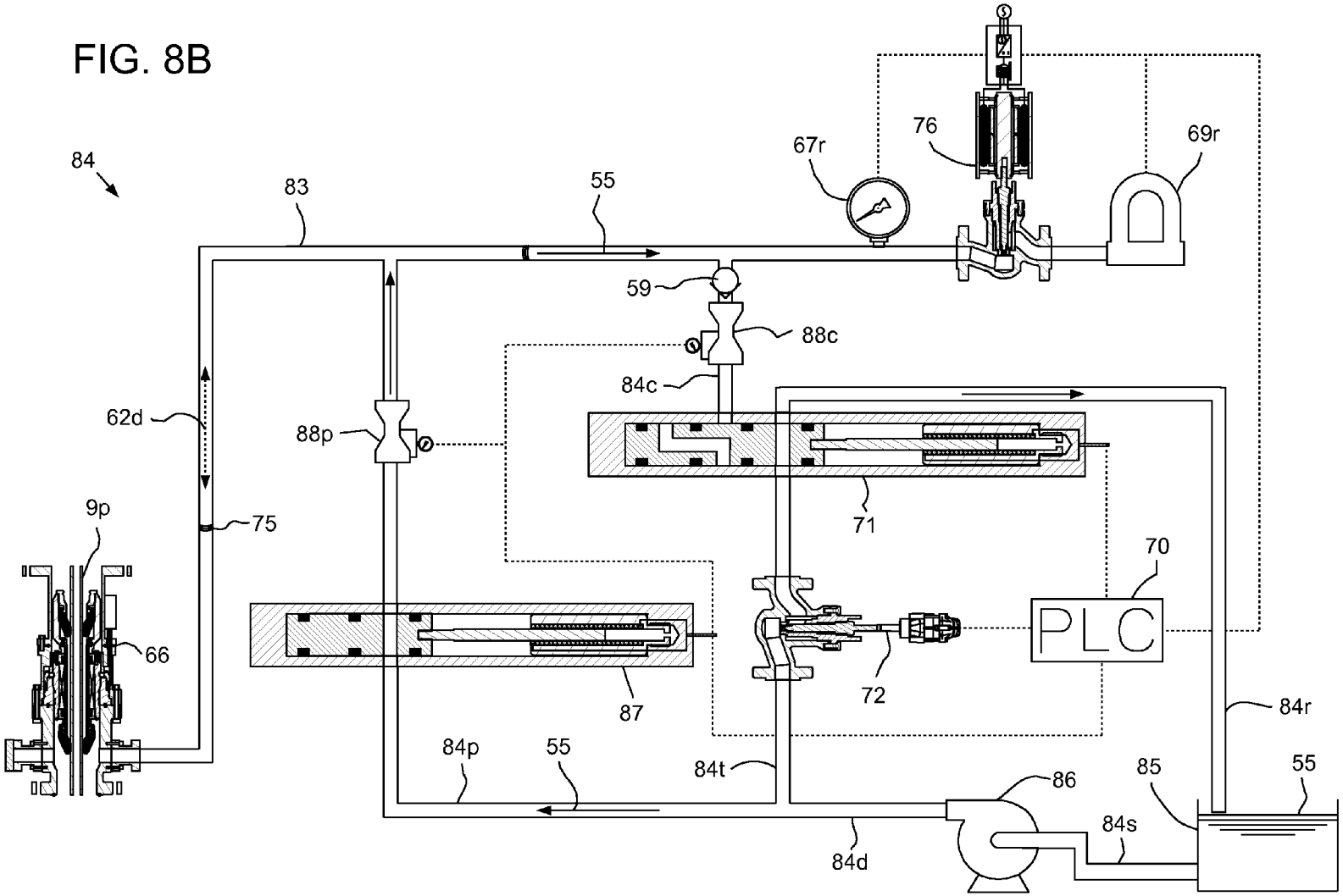
Figure 8C:
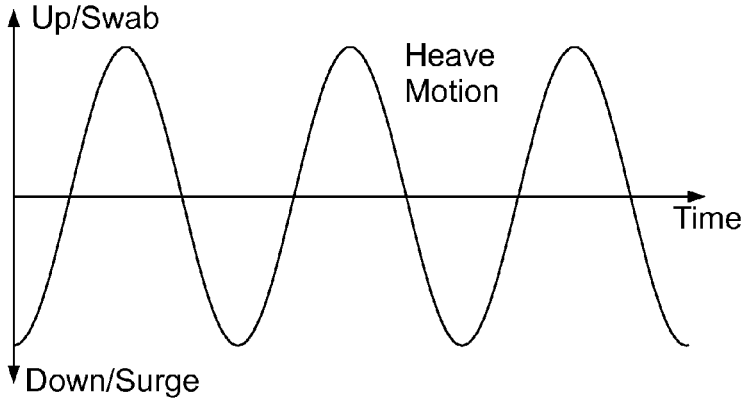

Referring specifically to FIG. 8C, once injection of the cement slurry 56 has finished, the bayonet connection between the CDA 9*d* and the inner casing string 15 may be released. The cementing head 7 (minus the isolation valve 6) may be removed and the workstring 9 connected to the isolation valve 6 and raised to create sufficient clearance between the equalization valve 52 and the casing hanger 15*h* to accommodate the heave 60 of the workstring 9. The spider 4*s* may then be operated to engage the drill pipe 9*p*, thereby longitudinally supporting the workstring 9 from the rig floor 4*f*.

Figure 8D:
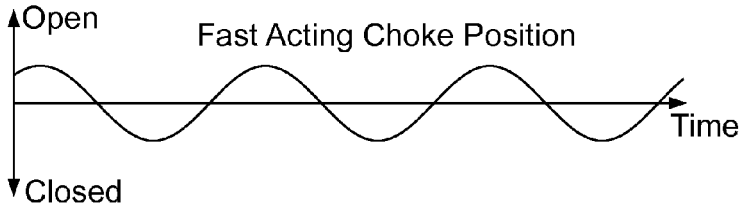
Figure 8E:
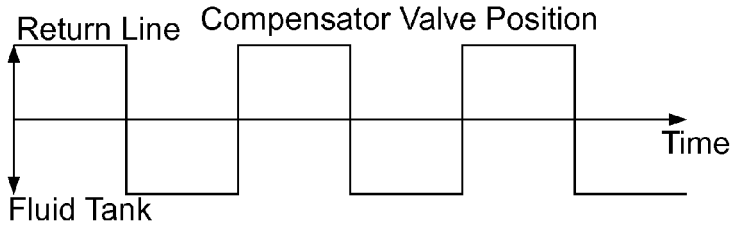

Referring specifically to FIGS. 8D and 8E, the auxiliary pump 86 may be activated to circulate conditioner 55 through the input spool 84*t* and loop spool 84*r*. The booster pump 44 may be left idle (depicted in phantom). The PLC 70 may utilize the heave sensor 82 to operate the fast acting choke 76 to dampen the heave pulse 62*d* by tightening the fast acting choke during a swab stroke of the heave 60 and relaxing the fast acting choke during a surge stroke of the heave. Even using the fast acting choke 76, there may be some latency (slight lag shown in FIG. 8D) between the fast acting choke position and the heave 60. To maintain the ability of the fast acting choke 76 to exert back pressure during a swab stroke of the heave 60, the PLC 70 may switch the compensator valve 71 to inject conditioner 55 into the return line 83 during the swab stroke. Once the swab stroke has finished, the PLC 70 may switch the compensator valve 71 back to discharging the conditioner 55 to the fluid tank 85.

Alternatively, the PLC 70 may monitor heaving 60 during injection of the cement slurry 56 to construct a predicted heave model and use the predicted heave model to control the fast acting choke and the compensator valve 71.

Figure 8F:
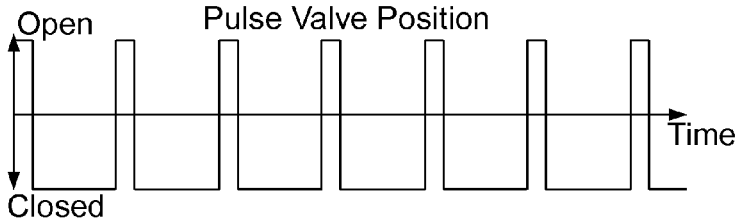
Figure 8G:
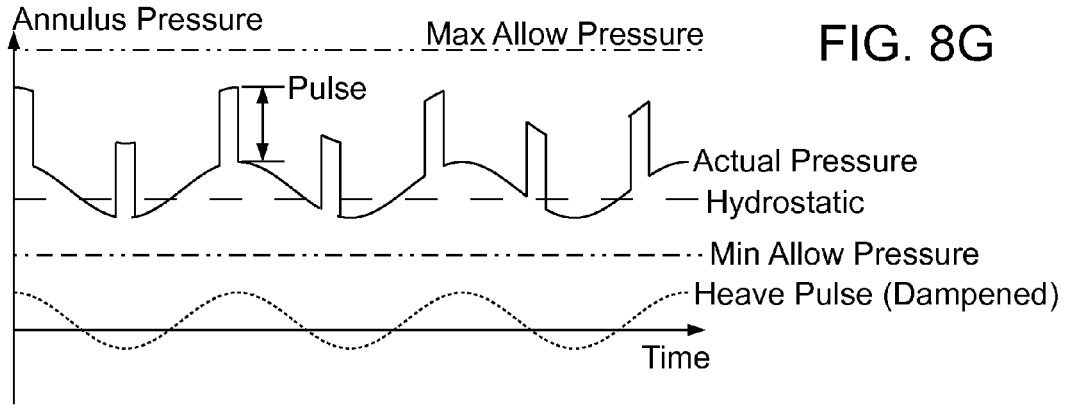

Referring specifically to FIGS. 8F and 8G, as the conditioner 55 is circulated, the intensifier valve 72 may be set to maintain a substantially higher pressure in the pulse spool 84*p* than the compensation 84*c* and return 84*r* spools. The PLC 70 may periodically reciprocate the pulse valve 87 to open and then close, thereby diverting the higher pressure flow of conditioner 55 into the return line 83 against the fast acting choke 76 and generating the choke pulse 75. The choke pulses 75 may be generated at any of the frequencies and magnitudes discussed above. The pulse frequency may be independent of the heave frequency and may even occasionally coincide with opening of the compensator valve 71 to the return line 83. The PLC 70 may control the pulse magnitude by adjusting a position of the intensifier choke 72 and/or time that the pulse valve 87 is kept open and monitoring the returns pressure sensor 67*r* for feedback. The PLC 70 may control pulse frequency by adjusting the reciprocation period of the pulse valve 87.

The actual pressure exerted on the cement slurry 56 may be a cumulative effect of the dampened heave pulse 62*d*, the hydrostatic pressure of the conditioner 55 in the annulus 48, the PCA annulus, and the riser annulus, and the choke pulses 75. The dampened heave pulse 62*d* may cause variation in the effective pulse magnitude exerted on the cement slurry 56; however, the PLC 70 may ensure that the effective magnitude during the swab stroke is still greater than or equal to the required pulse magnitude while also ensuring the actual pressure does not exceed the maximum allowable pressure of the lower formation 27*b*.

Circulation of the conditioner 55 and pulse generation may be maintained until the entire column of the cement slurry 56 has thickened sufficiently to prevent gas migration. As the conditioner 55 is being circulated, the PLC 70 may perform the mass balance using the heave sensor 82 to account for displaced volume by the heave 60 and the flow meters 69*r*, 88*c*, 88*p* to monitor for formation fluid entering the annulus 48 or cement slurry 56 entering the lower formation 27*b* to evaluate acceptability, as discussed above. Once the cement slurry 56 has cured to the thickened state, the CDA 9*d* may be reengaged with the casing packer 15*h*, the casing packer may be set, and the workstring 9 retrieved to the rig 1*r*.

Alternatively, an accumulator may be used to supply the conditioner to the return line for generation of the pulses instead of the pulse spool. Alternatively, the RCD may be omitted and the diverter closed against the workstring instead.

Figure 9:
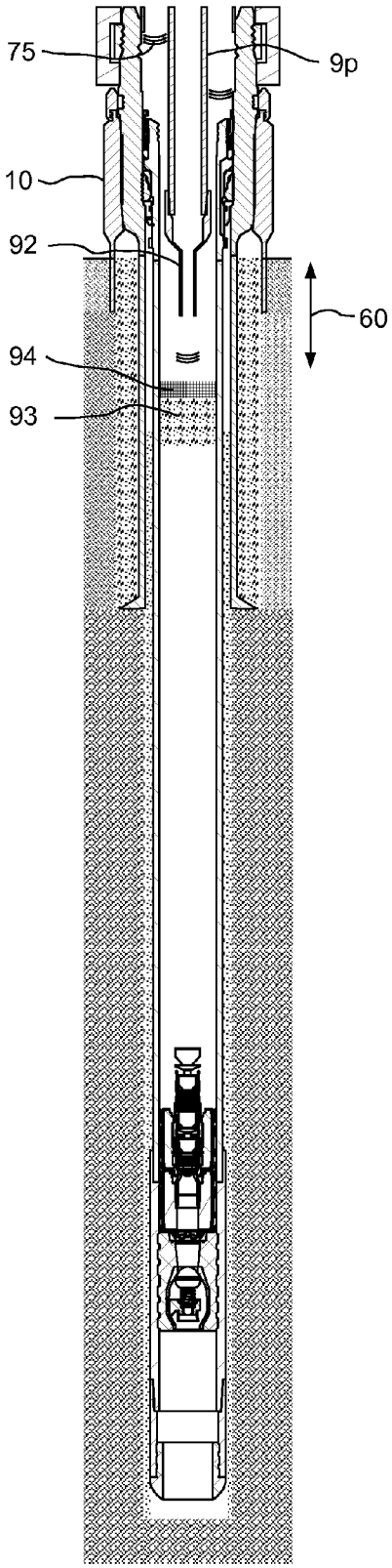
FIG. 9 illustrates cement pulsation during curing of a temporary abandonment cement plug, according to another embodiment of this disclosure.

FIG. 9 illustrates cement pulsation during curing of a temporary abandonment cement plug 93, according to another embodiment of this disclosure. The CDA 9*d* may removed from the workstring 9 and replaced by a stinger 92. The workstring 9*p*, 92 may be redeployed until the stinger 92 is located adjacent to the casing hanger 15*h*. Spacer fluid 94 may be pumped into the workstring 9*p*, 92 followed by the cement slurry 93. Chaser fluid (not shown) may be pumped into the workstring 9*p*, 92 to propel the cement slurry 93 and spacer fluid 94 through the stinger 92 until a level of the cement slurry in the inner casing string 15 is equal to a level of the cement slurry in the stinger (aka balanced plug). The drill pipe 9*p* may be raised to remove the stinger 92 from the cement slurry 93 and the cement slurry choke pulsed 75 until it has thickened sufficiently to prevent gas migration. The choke pulses 75 may be generated using any of the second, third, or fourth alternative drilling systems. Once the slurry 93 has thickened, the workstring 9*p*, 92 may be retrieved to the rig. The PCA 1*p* and riser string 17 may be retrieved to the rig and the MODU 1*m* dispatched from the wellsite. An intervention vessel (not shown) may then to be sent to the wellsite for completion of the wellbore 24.

Alternatively, the curing cement slurry 93 may be pulsed using heave pulses generated by the drilling system 1 or the first alternative drilling system.

Figure 10:
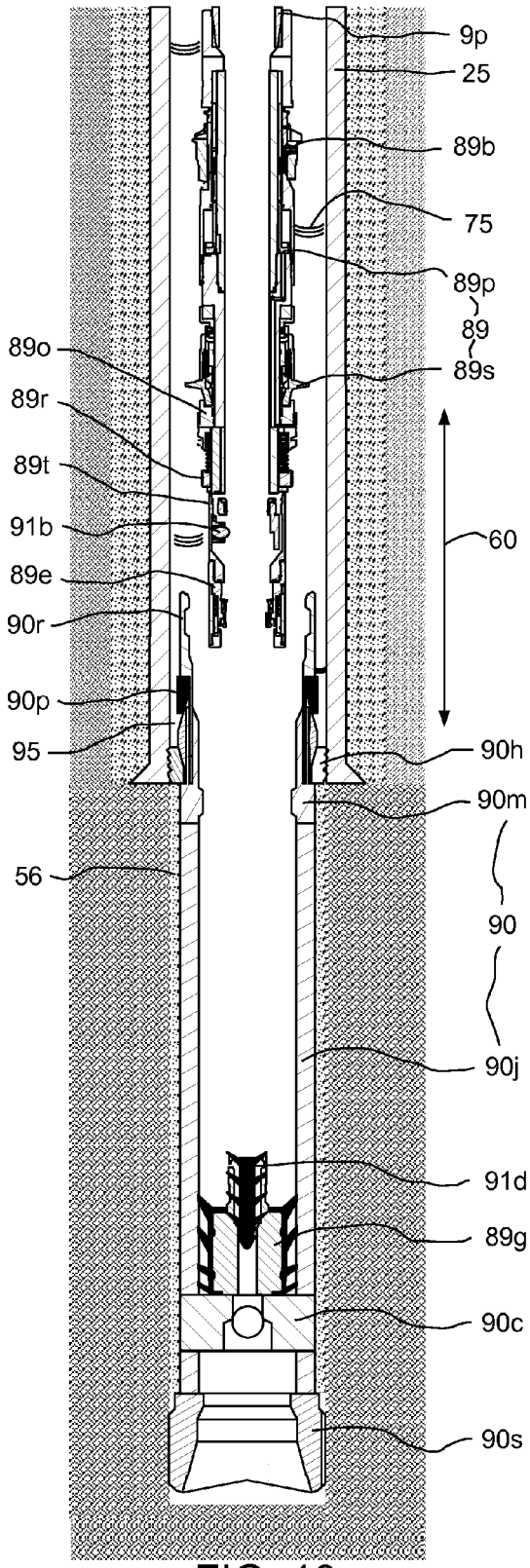
FIG. 10 illustrates cement pulsation of curing cement slurry in an annulus of a liner string, according to another embodiment of this disclosure.

FIG. 10 illustrates cement pulsation of curing cement slurry 56 in an annulus 95 of a liner string 90, according to another embodiment of this disclosure. A liner deployment assembly (LDA) 89 may be used to deploy the liner string 90 instead of the CDA 9*d*. The liner string 90 may include a polished bore receptacle (PBR) 90*r*, a packer 90*p*, a liner hanger 90*h*, a mandrel 90*m* for carrying the hanger and packer, joints of liner 90*j*, a landing collar 90*c*, and a reamer shoe 90*s*. The mandrel 90*m*, liner joints 90*j*, landing collar 90*c*, and reamer shoe 90*s* may be interconnected, such as by threaded couplings.

The LDA 89 may include a setting tool 89*b,o,p,s*, a running tool 89*r*, a catcher 89*t*, and a plug release system 89*e,g*. An upper end of the setting tool 89*b,o,p,s* may be connected to a lower end the drill pipe 9*p*, such as by threaded couplings. A lower end of the setting tool 89*b,o,p,s* may be fastened to an upper end of the running tool 89*r*. The running tool 89*r* may also be releasably connected to the mandrel 90*m*. An upper end of the catcher 89*t* may be connected to a lower end of the running tool 89*r* and a lower end of the catcher may be connected to an upper end of the plug release system 89*e,g*, such as by threaded couplings.

For deployment of the liner string 90, a junk bonnet 89*b* of the setting tool 89*b,o,p,s* may be engaged with and close an upper end of the PBR 90*r*, thereby forming an upper end of a buffer chamber. A lower end of the buffer chamber may be formed by a sealed interface between a packoff 89*o* of the setting tool 89*b,o,p,s* and the PBR 90*r*. The buffer chamber may be filled with a buffer fluid (not shown), such as fresh water, refined/synthetic oil, or other liquid. The buffer chamber may prevent infiltration of debris from the wellbore 24 from obstructing operation of the LDA 9*d*.

The setting tool 89*b,o,p,s* may include a hydraulic actuator 89*p* for setting the liner hanger 90*h* and a mechanical actuator 89*s* for setting the liner packer 90*p*. The cementing head 7 may be modified for use with the LDA 89 by replacing one of the release plug launchers with a setting plug launcher. The setting plug may be a ball 91*b* pumped down the workstring 9*p*, 89 to the catcher 89*t*. The catcher 89*t* may be a mechanical ball seat including a body and a seat fastened to the body, such as by one or more shearable fasteners. The seat may also be linked to the body by a cam and follower. Once the ball 91*b* is caught, the seat may be released from the body by a threshold pressure exerted on the ball. The threshold pressure may be greater than a pressure required to set the liner hanger 90*h*, unlock the running tool 53, and release the junk bonnet 89*b*. Once the seated ball has been released, the seat and ball 91*b* may swing relative to the body into a capture chamber, thereby reopening the LDA bore.

Once the liner hanger 90*h* has been set against an inner surface of a lower portion, such as the bottom, of the outer casing string 25 and the running tool 89*r* unlocked, the workstring 9*p*, 89 may be rotated, thereby releasing a floating nut of the running tool from a threaded profile of the mandrel 90*m*. The workstring 9*p*, 89 may be raised to verify successful release and lowered to torsionally engage the LDA 9*d* with the liner string 90 for rotation during pumping of the cement slurry 56. The cement slurry 56 may be pumped followed by a dart 91*d* to release the wiper plug 89*g* from the plug release system 89*e,g*. Once pumping of the cement slurry 56 has finished, the cementing head (minus the isolation valve) may be removed and the workstring 9*p*, 89 connected to the isolation valve and raised to create sufficient clearance between the equalization valve 89*e* and the liner hanger 90*h* to accommodate the heave 60 of the workstring 9. The spider 4*s* may then be operated to engage the drill pipe 9*p*, thereby longitudinally supporting the workstring 9 from the rig floor 4*f*. The cement slurry 56 may be pulsed 75 and pulse generation may be maintained until the entire column of the cement slurry 56 has thickened sufficiently to prevent gas migration. The LDA 89 may then be lowered until the mechanical actuator 89*s* engages the liner packer 90*p* and lowering may continue to set the liner packer.

The pulsation 75 of the cement slurry 56 in the liner annulus 95 may be performed using the second, third, or fourth alternative drilling systems. Alternatively, the curing cement slurry 56 in the liner annulus 95 may be pulsed using heave pulses generated by the drilling system 1 or the first alternative drilling system.

While the foregoing is directed to embodiments of the present disclosure, other and further embodiments of the disclosure may be devised without departing from the basic scope thereof, and the scope of the invention is determined by the claims that follow.

What is claimed is:

1. A method for cementing a tubular string into a wellbore from a drilling unit, comprising:

running the tubular string into the wellbore using a workstring;

hanging the tubular string from a wellhead or from a lower portion of a casing string set in the wellbore;

pumping cement slurry through the workstring and tubular string and into an annulus formed between the tubular string and the wellbore; and during thickening of the cement slurry:

circulating a liquid or mud through a loop closed by a seal engaged with an outer surface of the workstring, the closed loop being in fluid communication with the annulus, and periodically choking the liquid or mud, thereby pulsing the cement slurry.

2. The method of claim 1, wherein the cement slurry is pulsated until the cement slurry has sufficiently thickened to prevent gas migration.

3. The method of claim 1, wherein the liquid or mud is choked by operating a fast acting toggle valve having an outlet connected to a choke valve and an outlet connected to a bypass line.

4. The method of claim 1, wherein the liquid or mud is choked by operating a fast acting choke valve.

5. The method of claim 1, further comprising performing a mass balance during thickening of the cement slurry, wherein the performing a mass balance comprises:

monitoring a plurality of flow meters for flow measurements; and comparing the flow measurements to detect a fluid ingress or egress into a formation exposed to the annulus.

6. The method of claim 5, further comprising using the mass balance to evaluate acceptability of the thickened cement, wherein acceptability comprises the cement slurry has sufficiently thickened to prevent gas migration.

7. The method of claim 1, further comprising setting a packer of the tubular string after thickening of the cement slurry.

8. The method of claim 1, further comprising rotating the tubular string during pumping of the cement slurry.

9. The method of claim 1, wherein:

the method further comprises conditioning the wellbore with a liquid or mud before pumping the cement slurry, and the cement slurry is pumped using a liquid or mud chaser fluid.

10. The method of claim 1, wherein the tubular string is an inner casing string.

11. The method of claim 10, further comprising:

spotting cement slurry in a bore of the inner casing string adjacent to the subsea wellhead; and pulsing the spotted cement slurry during thickening thereof.

12. The method of claim 1, wherein the tubular string is a liner string.

13. The method of claim 1, wherein:

the wellbore is a subsea wellbore, the wellhead is a subsea wellhead, and the drilling unit is an offshore drilling unit.

14. The method of claim 13, wherein the workstring is suspended from a top drive of the offshore drilling unit during pulsation.

15. The method of claim 13, wherein:

the tubular string is run into the subsea wellbore through a marine riser, the seal is part of a rotating control device (RCD), and the RCD is part of an upper marine riser package connecting the marine riser to the offshore drilling unit.

16. A method for cementing a tubular string into a subsea wellbore from an offshore drilling unit, comprising:

running the tubular string into the subsea wellbore using a workstring;

hanging the tubular string from a subsea wellhead or from a lower portion of a casing string set in the subsea wellbore;

pumping cement slurry through the workstring and tubular string and into an annulus formed between the tubular string and the subsea wellbore;

closing a seal against an outer surface of the workstring and closing a return line, thereby forming a closed heave chamber in fluid communication with the annulus; and maintaining the closed heave chamber during thickening of the cement slurry, thereby utilizing heaving of the offshore drilling unit to pulsate the cement slurry.

17. The method of claim 16, wherein the seal is closed against the outer surface of the workstring after pumping the cement slurry.

18. The method of claim 16, further comprising:

releasing a deployment assembly of the workstring from the tubular string;

raising the deployment assembly from the tubular string to accommodate the heave; and anchoring the workstring to the offshore drilling unit during pulsation.

19. The method of claim 16, wherein:

the seal is a dynamic seal, and the workstring is suspended from a top drive of the offshore drilling unit during pulsation.

20. The method of claim 19, wherein:

the dynamic seal is part of a rotating control device (RCD) converter, and the dynamic seal is closed by installing the RCD converter in a diverter of the offshore drilling unit.

21. The method of claim 16, further comprising, immediately after forming the heave chamber, exerting a back pressure on the annulus and sealing the annulus with the exerted back pressure.

22. A method for cementing a tubular string into a subsea wellbore from an offshore drilling unit, comprising:

running the tubular string into the subsea wellbore using a workstring having a deployment assembly;

hanging the tubular string from a subsea wellhead or from a lower portion of a casing string set in the subsea wellbore;

pumping cement slurry through the workstring and tubular string and into an annulus formed between the tubular string and the subsea wellbore;

releasing the deployment assembly from the tubular string;

raising the deployment assembly from the tubular string to accommodate heave;

anchoring the workstring to the offshore drilling unit; and during thickening of the cement slurry and while a seal is engaged with an outer surface of the workstring:

using a heave sensor to monitor the heave, injecting liquid or mud into a return line in fluid communication with the annulus during a swab stroke of the heave, the liquid or mud being injected upstream of a fast acting choke valve, and operating the fast acting choke valve to dampen a pulse exerted on the cement slurry by the heave.

23. The method of claim 22, further comprising periodically injecting the liquid or mud into the return line upstream of the fast acting choke valve, thereby pulsing the cement slurry.

24. The method of claim 22, wherein:

the tubular string is run into the subsea wellbore through a marine riser, and an upper marine riser package (UMRP) connects the marine riser to the offshore drilling unit.

25. The method of claim 24, wherein the heave sensor is part of a slip joint of the UMRP.

26. The method of claim 24, wherein:

the seal is part of a rotating control device (RCD), and the RCD is part of the UMRP located below the slip joint.

* * * * *